US009784510B2

(12) United States Patent
Al-Otaibi

(10) Patent No.: US 9,784,510 B2
(45) Date of Patent: Oct. 10, 2017

(54) CLEANING APPARATUS FOR HEAT EXCHANGE TUBES OF AIR COOLED HEAT EXCHANGERS

(71) Applicant: Saudi Arabian Oil Company, Dhahran (SA)

(72) Inventor: Abdullah M. Al-Otaibi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 336 days.

(21) Appl. No.: 14/245,087

(22) Filed: Apr. 4, 2014

(65) Prior Publication Data

US 2014/0326280 A1 Nov. 6, 2014

Related U.S. Application Data

(63) Continuation-in-part of application No. 13/726,452, filed on Dec. 24, 2012, now Pat. No. 8,974,607.

(60) Provisional application No. 61/580,821, filed on Dec. 28, 2011.

(51) Int. Cl.

| | |
|---|---|
| ***F28G 1/16*** | (2006.01) |
| ***F28G 15/04*** | (2006.01) |
| ***F28D 1/053*** | (2006.01) |
| ***F28F 1/24*** | (2006.01) |
| *F28B 1/06* | (2006.01) |

(52) U.S. Cl.

CPC ..... *F28G 1/166* (2013.01); *F28D 1/05341* (2013.01); *F28F 1/24* (2013.01); *F28G 15/04* (2013.01); *F28B 1/06* (2013.01)

(58) Field of Classification Search

CPC ..... F28F 1/166; F28G 1/166

See application file for complete search history.

(56) References Cited

U.S. PATENT DOCUMENTS 5,279,357 A * 1/1994 Kennon ..... F28G 3/166 122/391

FOREIGN PATENT DOCUMENTS

DE G9418733.9 * 12/1995

* cited by examiner

*Primary Examiner* — Jason Ko

(74) *Attorney, Agent, or Firm* — Abelman, Frayne & Schwab

(57) ABSTRACT

A spray mat for spraying cleaning fluid under pressure onto the outer surfaces of heat exchange tubes that extend in rows in a heat exchanger, the rows of tubes being spaced apart from each other with a generally planar space defined between each two adjacent rows, the spray mat formed of a plurality of spray strips, each spray strip including: (a) a base part having upper and lower surfaces, (b) a fluid inlet, (c) a plurality of spray nozzles spaced apart and secured on the upper and lower surfaces, and (d) a duct system for fluid coupling the fluid inlet to the spray nozzles, each spray strip is bendably and fluid coupled to the next forming a flexible spray mat which is positionable into and removable out of selected ones of the planar spaces between each two adjacent rows of the heat exchange tubes.

11 Claims, 25 Drawing Sheets

Figure 1:
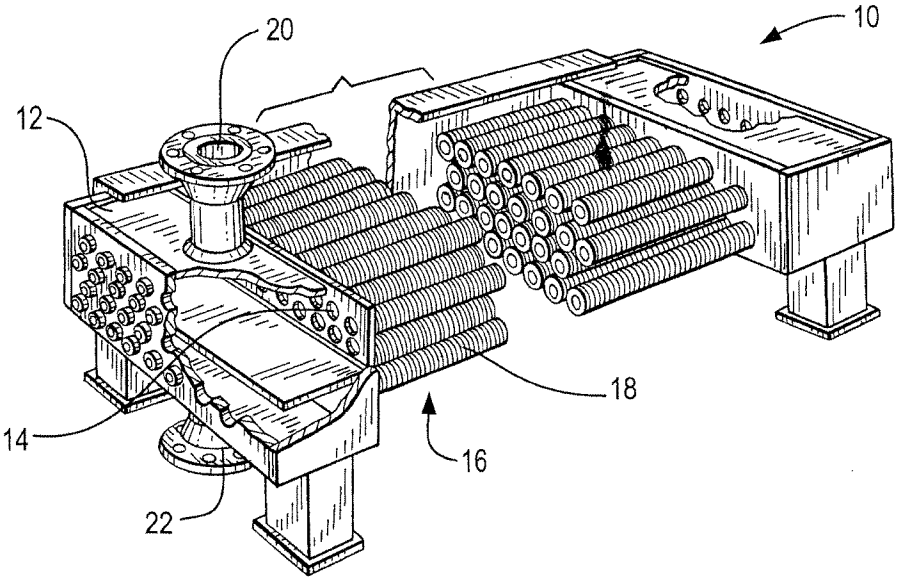

FIG. 32
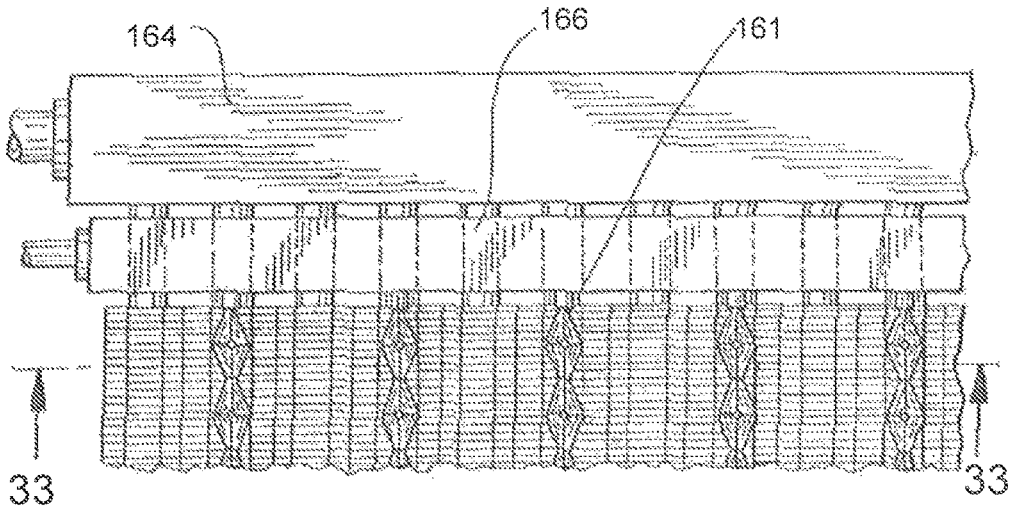
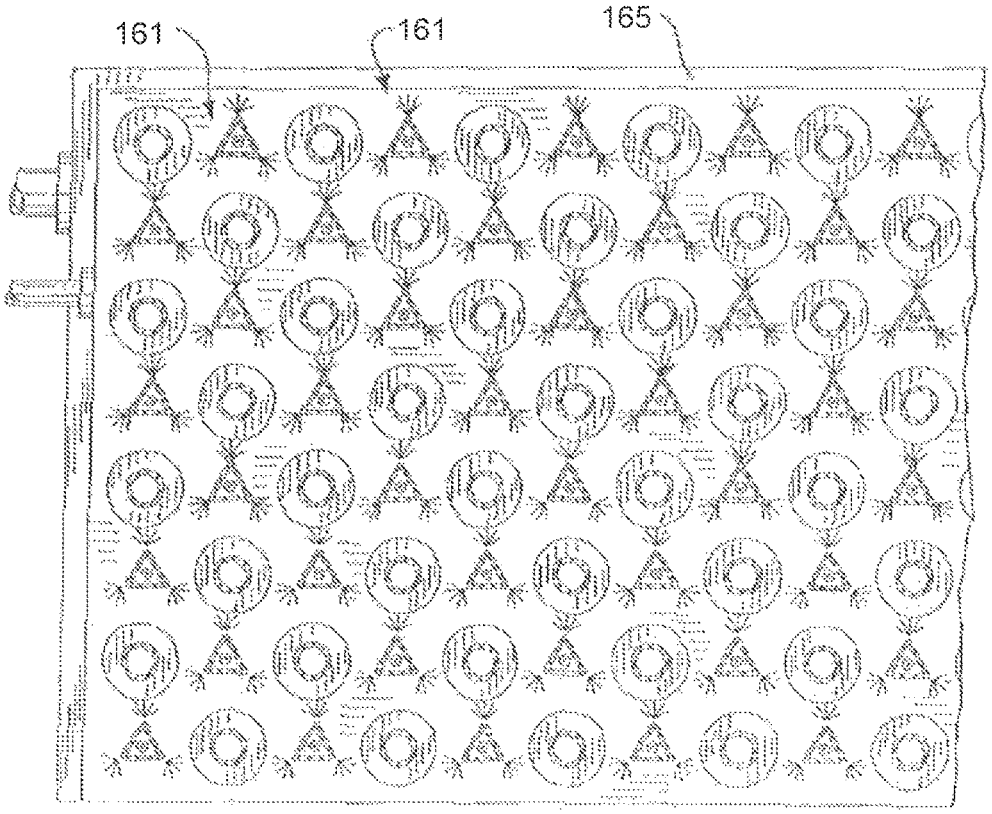
FIG. 33

CLEANING APPARATUS FOR HEAT EXCHANGE TUBES OF AIR COOLED HEAT EXCHANGERS

RELATED CASES

This is Continuation-In-Part of U.S. application Ser. No. 13/726,452 filed Dec. 24, 2012 and U.S. Provisional Application 61/580,821 filed Dec. 28, 2011

I. FIELD OF THE INVENTION

This invention is in the field of air cooled heat exchangers and particularly methods and apparatus for cleaning the outer surfaces of bundles of heat exchange tubes of air cooled heat exchangers.

II. BACKGROUND AND PRIOR ART

In certain large scale facilities for production, treatment, storage and distribution of gas and liquid products there are a large number of air cooled heat exchangers. These facilities have experienced substantially excessive high power consumption and low performance due to fouling accumulation on external surfaces of cooling fins as heat exchange tubes. This is particularly true in an environment like that of Saudi Arabia where the air is filled with heavy dust so that tube bundles of air cooled heat exchangers become externally plugged in a short period of time and require frequent and extensive cleaning. Existing cleaning methods are known to be both expensive and not fully successful because of heat exchanger construction where many tubes with their closely spaced fins are packed in relatively tight bundles. Many surfaces are not reached by the cleaning liquid or spray since many are below or otherwise blocked by others closer to the source of the cleaning spray. The same problem exists even with mechanical brushing or scraping, as there are such a great many areas that are simply not accessible.

The present invention seeks to provide new and improved apparatus and methods for cleaning the external surfaces of finned tubes of air cooled heat exchangers.

III. OBJECTS AND SUMMARY OF THE INVENTION

A first object is to provide a new apparatus and method for cleaning the external surfaces of heat exchange tubes in air cooled heat exchangers which provides more effective cleaning and without additional power consumption and with less damage to the cooling fins and heat exchange tubes.

Another object is to provide a method and apparatus where the cleaning spray heads are carried by a central body and moved laterally between layers of tubes and/or axially along between said layers, to position the spray heads in the closest possible proximity to the outer surfaces of the heat exchange tubes.

A further object of the invention is to provide a great plurality of spray heads carried by a laminate sheet that is movable between layers of tubes of the tube bundle and to thereby spray large areas simultaneously with spray directed at short range onto the external surfaces.

A still further object of the invention is to provide a structure to hold and transport a great many spray nozzles, the structure being in the form of a sheet which is movable axially or transversely of the space above a top layer or between adjacent layers of tubes.

It is a still further object for the nozzle carrying element to have an air mattress type structure comprising upper and lower sheets welded together in designated areas to define liquid flow passages from an inlet to the multiple outlet spray nozzles.

An additional object is to provide a transport mechanism for moving a sheet as described above in said transverse and axial directions for cleaning, and to subsequently fully remove such sheet from the area adjacent said tubes.

An additional object is to provide rollers and drive means for rolling up said sheet in an area external of the tube bundle when the sheet is not in use, and for facilitating subsequent delivery of the sheet to the areas above or between rows of tubes.

A still further object is to provide in said sheet outlet nozzles which will pop out externally of the sheet surface under the influence of cleaning fluid pressure being directed through said sheet and to said nozzles, for the purpose of moving the nozzles closer to the surface areas being cleaned.

Another object is to provide a spring element in the above-described nozzles biasing them to their retracted position when not urged by the fluid pressure, so that the sheet with its retracted nozzles will be as thin as possible for maneuvering into the spaces between rows and layers of said tubes. With the above type of new structure and method, the sheet with its outlet nozzles can be rolled up for storage or can be unrolled and slid into the narrow spaces between layers of tubes of the tube bundle.

A still further object is to provide a secondary sheet generally located below the primary spray sheet to collect the soiled water while cleaning different rows. This secondary sheet can be fixed at one location below the tube-bundles to cover the whole area while the spray sheet cleans the different rows within the tube-bundles from top toward bottom and moves laterally to different sections. Moreover, the secondary sheet can be designed to be parallel and spaced below the primary spray sheet and movable essentially at the same time in the same way. Thus, if the spray sheet is above the top row, the collection sheet would be below the top row. If the spray sheet is between the top row and the second row down, the collection sheet would be between the second and third rows. In this manner the purpose of the collection sheet is to collect the soiled water and cleaned-off fouling substances from the rows of tubes that have been cleaned, and to drain this collected fluid off to a separate external area, so that it does not drip down onto equipment and electric motors located beneath the air-cooled heat exchangers (ACHE). The collection sheet is also called the sink while the spray sheet is also called the source.

The objects are further illustrated by the embodiments described below.

1. A spray mat for spraying cleaning fluid from a source of cleaning fluid under pressure onto the outer surfaces of heat exchange tubes that extend in rows in a heat exchanger, said rows of tubes being spaced apart from each other with a generally planar space defined between each two adjacent rows of said heat exchange tubes, said spray mat formed of a plurality of spray strips, each spray strip comprising:

a. a base part having upper and lower surfaces, b. a fluid inlet, c. a plurality of spray nozzles spaced apart from each other and secured on at least one of said upper and lower surfaces, which spray nozzles are thus oriented to face upward and/or downward respectively, and d. a duct system for fluid coupling said fluid inlet to said spray nozzles, said plurality of spray strips being coupled together forming said spray mat where each spray strip is bendably coupled to the next, and said spray strips are fluid coupled together to allow flow of said cleaning fluid from one spray strip to the next, said spray mat being positionable into and removable out of selected ones of said planar spaces between each two adjacent rows of said heat exchange tubes, whereby cleaning fluid can be sprayed onto the outer surfaces of said heat exchange tubes in each row adjacent said planar space.

2. The spray mat according to embodiment 1 wherein said base part comprises a frame formed of tubular parts having continuous internal bore passages, where said duct system includes said bore passages of said tubular frame.

3. The spray mat according to embodiment 2 wherein said frame has a generally rectangular shape and includes a tube extending within said rectangular shape and lengthwise thereof, said tube being in fluid communication with said bore passages and said nozzles being in fluid coupling with said tube.

4. The spray mat according to embodiment 2 comprising at least one additional inlet from said source to said duct system.

5. The spray mat according to embodiment 3 wherein one of said inlets is situated at each of said opposite ends of said rectangular frame and is in fluid communication therewith.

6. The spray mat according to embodiment 1 comprising a plurality of said spray strips situated one adjacent to the next along their rectangular side edges, said spray mat further comprising at least one hinge between the adjacent side edges of each two adjacent spray strips, and at least one connection duct fluid coupling each of said spray strips to the next adjacent spray strip.

7. The spray mat according to embodiment 6 further comprising a manifold situated adjacent the ends of said plurality of spray strips, said manifold fluid coupling said source of cleaning fluid to said inlets to said spray strips.

8. The spray mat according to embodiment 1 further comprising guide tracks attachable to said heat exchanger, and follower elements at each end of said spray strip engageable into said guide tracks to facilitate positioning of said spray mat into said planar space.

9. The spray mat according to embodiment 1 where each of said spray strips has a plurality of said spray nozzles on each of said upper and lower surfaces respectively.

10. The spray mat according to embodiment 1 wherein each of said nozzles comprises (a) a generally conical housing with a bottom part engaged to said base part, each of said housings having a retracted state where said housing is compressed to a generally flat state, and an extended state where said housing forms a conical shape, and (b) a coil spring situated inside said housing urging said housing to said retracted state, said housing being extendable when cleaning fluid enters said housing under pressure, urging said housing to said extended state, said housing including a plurality of openings for spraying said cleaning fluid outward.

11. The spray mat according to embodiment 10 wherein said nozzles are situated in pairs extending upward and downward from said base part, each pair of nozzles having a single one of said coil springs extending in both nozzles of each pair.

12. The spray mat according to embodiment 10 wherein said nozzles are situated in pairs extending upward and downward from said base part, each of said nozzles having its own coil spring.

13. A spray cleaning system comprising a spray mat according to embodiment 1 and a collection mat having generally the same horizontal area and having a central drain aperture for discharge of soiled cleaning fluid that had been sprayed from said spray mat.

14. A spray mat for spraying cleaning fluid from a source of cleaning fluid under pressure onto the outer surfaces of heat exchange tubes in a heat exchanger which, as defined in an X, Y, Z coordinate system, has a plurality of said heat exchange tubes that extend generally parallel in the X-direction in rows, where said heat exchange tubes in each row are spaced apart in the Y-direction, said rows being spaced apart from each other in the Z-direction, with a generally planar space defined between each two adjacent rows of said heat exchange tubes, said spray mat comprising at least one spray strip, which comprises:

a. a base part having upper and lower surfaces, b. a fluid inlet, c. a plurality of spray nozzles spaced apart from each other and secured on at least one of said upper and lower surfaces, which spray nozzles are thus oriented to face upward and/or downward respectively, and d. a duct system for fluid coupling said fluid inlet to said spray nozzles, said spray nozzles being spaced apart in said X-direction, each said spray nozzle, when said spray mat is in one of said planar spaces, adapted to direct cleaning fluid onto said heat exchange tubes in each row adjacent said planar space, each of said spray mats being positionable into and removable out of said planar space between two adjacent rows of heat exchange tubes.

15. A method employing a spray mat according to embodiment 1, for spraying cleaning fluid under pressure onto the outer surfaces of heat exchange tubes that extend in rows in a heat exchanger, said rows of heat exchange tubes being spaced apart from each other with a generally planar space defined between each two rows of said heat exchange tubes, said method comprising the steps:

a. positioning said spray mat sequentially into selected ones of said planar spaces, b. directing said cleaning fluid from said source through said duct system and outward of said spray nozzles onto outer surfaces of said heat exchange tubes adjacent said spray mat, and c. subsequently removing said spray mat from said planar space.

16. The method according to embodiment 15 wherein said spray mat comprises a plurality of said spray strips that are bendably connected to each other, said method after said spray mat is removed from said planar space, comprising the further step of folding each spray strip relative to a spray strip adjacent thereto into a stack for storage.

17. The method according to embodiment 15 wherein said spray mat comprises a plurality of said spray strips that are bendably connected to each other, said method after said spray mat is removed from said planar space, comprising the further step of rolling said coupled spray strips onto a roller for storage.

18. The method of embodiment 15 comprising the further step of positioning a fluid collection sheet between two adjacent rows of said heat exchange tubes that are at an elevation below the adjacent two rows of said heat exchange tubes between which said spray mat was inserted said collection sheet adapted to receive and discharge soiled cleaning fluid that was sprayed by said nozzles.

19. A spray apparatus for spraying cleaning fluid from a source of cleaning fluid under pressure onto the outer surfaces of heat exchange tubes that extend in rows in an air cooled heat exchanger, said rows of tubes being spaced apart from each other with a generally planar space defined between each two adjacent rows of said heat exchange tubes, said spray apparatus formed of a plurality of spray strips, each spray strip comprising:

a. a central supply tube having an inlet in at least one end and having outlet apertures extending transversely through said central supply tube wall along its length, b. a plurality of spray controllers situated lengthwise along said central supply tube, each spray controller formed as a cylinder through which said central supply tube extends axially, each spray controller including on its outer surface a plurality of spray nozzles which are focused in a variety of directions and including a plurality of outlet apertures for supplying fluid from said central supply tube to said plurality of spray nozzles, and d. a manifold for supplying fluid from said source to said inlets to said central supply tubes and for coupling together a plurality of said spray strips into a frame.

20. The spray apparatus according to embodiment 19 where each of said spray controllers comprises a generally pyramidal shape with its base adjacent the outer surface of said spray controller and its apex extending outward therefrom.

21. The spray apparatus according to embodiment 19 where each of said spray controllers comprises a hemispherical shape with its base part adjacent said outer surface of said spray controller and an opposite convex outer surface.

22. The spray apparatus according to embodiment 19 where said spray controllers are fixed in relationship to each other in an end-to-end relationship and fixed to said central supply tube.

23. The spray apparatus according to embodiment 19 further comprising a spring-collar at each end of said central supply tube engaging and urging said spray controllers into tight mutual engagement.

24. An air cooled heat exchanger comprising:

a. a housing, b. a plurality of exchange tubes mounted in said housing and extending in rows that are spaced apart from each other with a generally planar space defined between each two adjacent rows of said heat exchange tubes, c. a spray apparatus formed of a plurality of spray strips, each spray strip comprising:

i. a central supply tube having an inlet in at least one end and having outlet apertures extending transversely through said central supply tube wall along its length, ii. a plurality of spray controllers situated lengthwise along said central supply tube, each spray controller formed as a cylinder through which said central supply tube extends axially, each spray controller including on its outer surface a plurality of spray nozzles which are focused in a variety of directions and a plurality of outlet apertures for supplying fluid from said central supply tube to said plurality of spray nozzles, and iii. a manifold for supplying fluid from said source to said inlets to said central supply tubes and for coupling together a plurality of said spray strips into a frame, said frame being mountable in said housing.

25. The spray apparatus according to embodiment 24 where said heat exchange tubes have a non-finned area at their ends and said cleaning fluid manifold extends transversely of said spray strips and is situated in said heat exchanger housing in a non-finned area of said heat exchange tubes.

These and other objects and advantages of the invention will be further understood and appreciated by those skilled in the art by reference to the following written specification, claims and appended drawings

IV. BRIEF DESCRIPTION OF THE DRAWINGS

Figure 2:
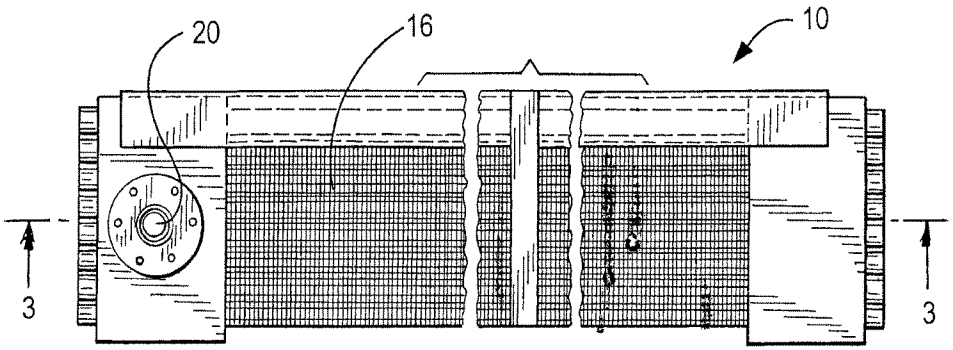
Figure 3:
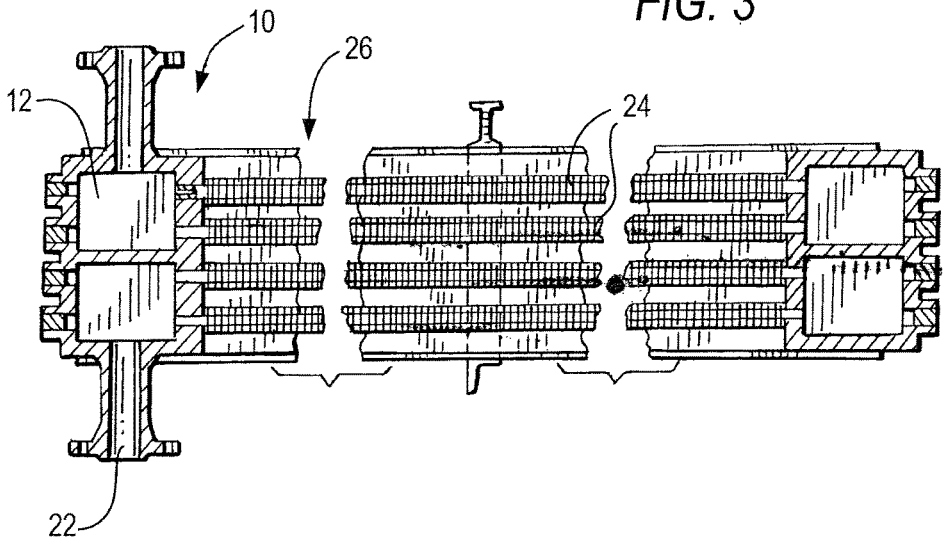
Figure 4:
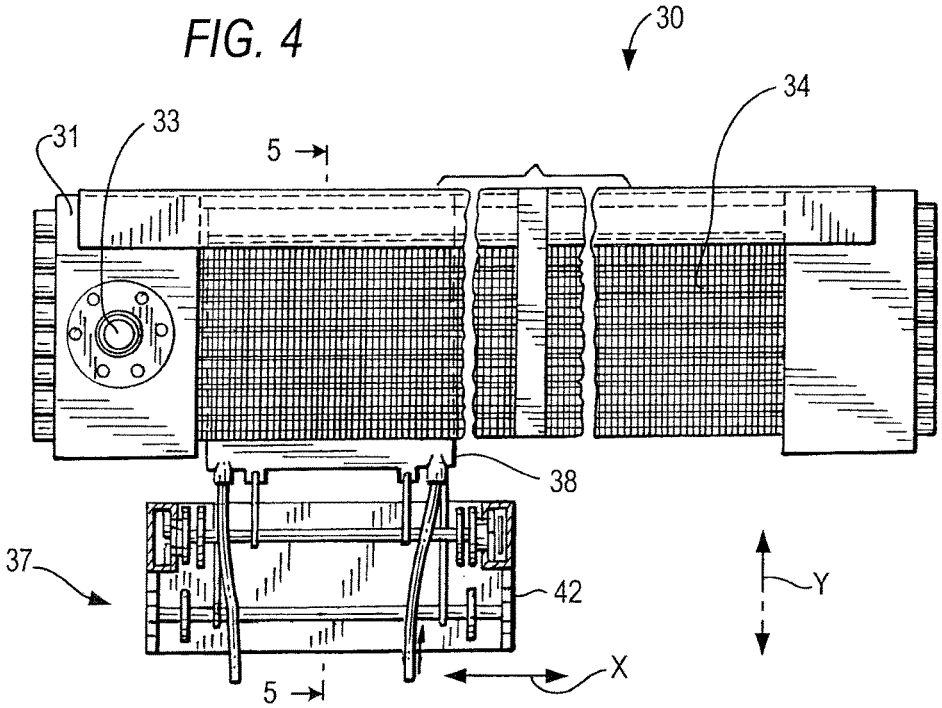
Figure 5:
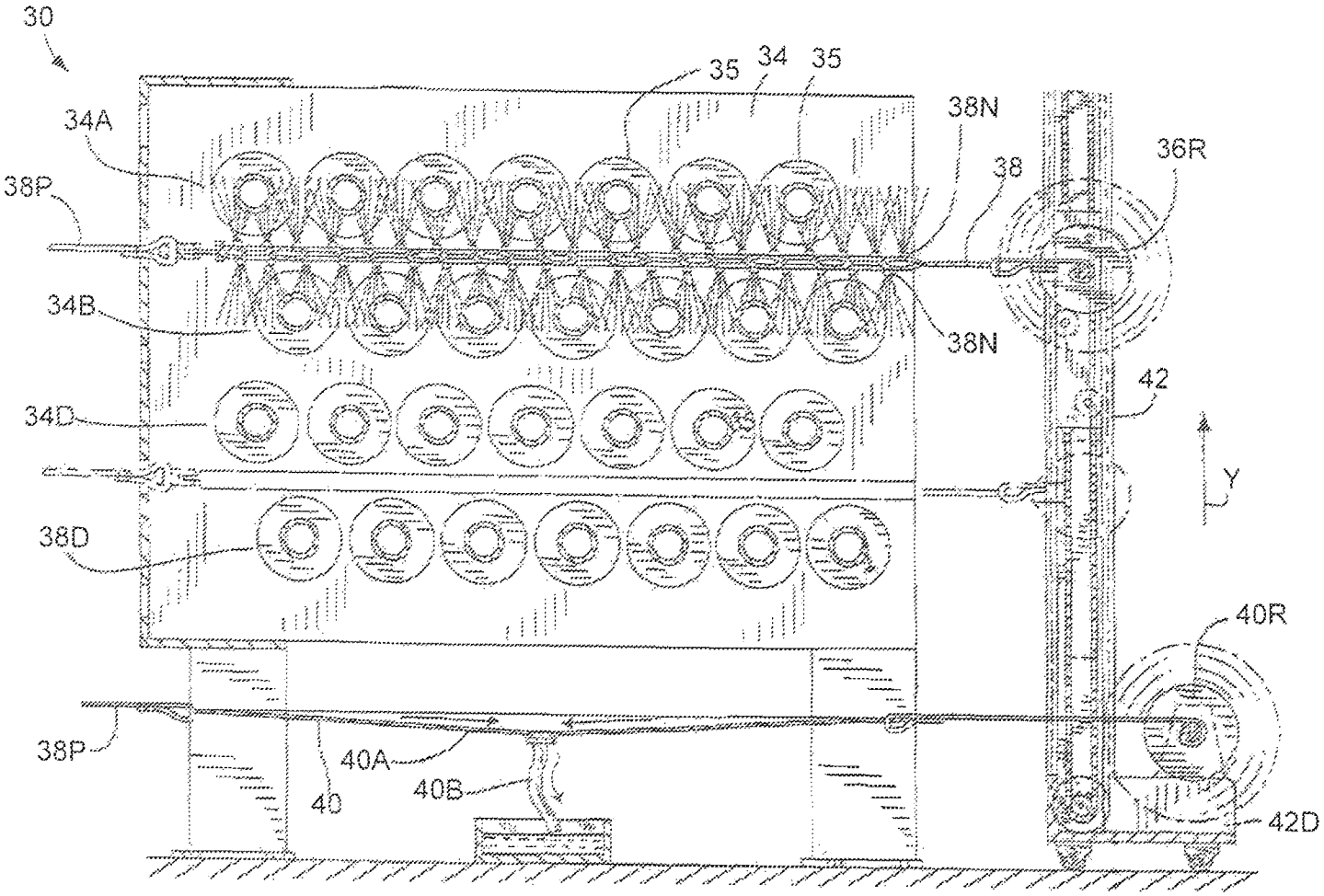
Figure 6:
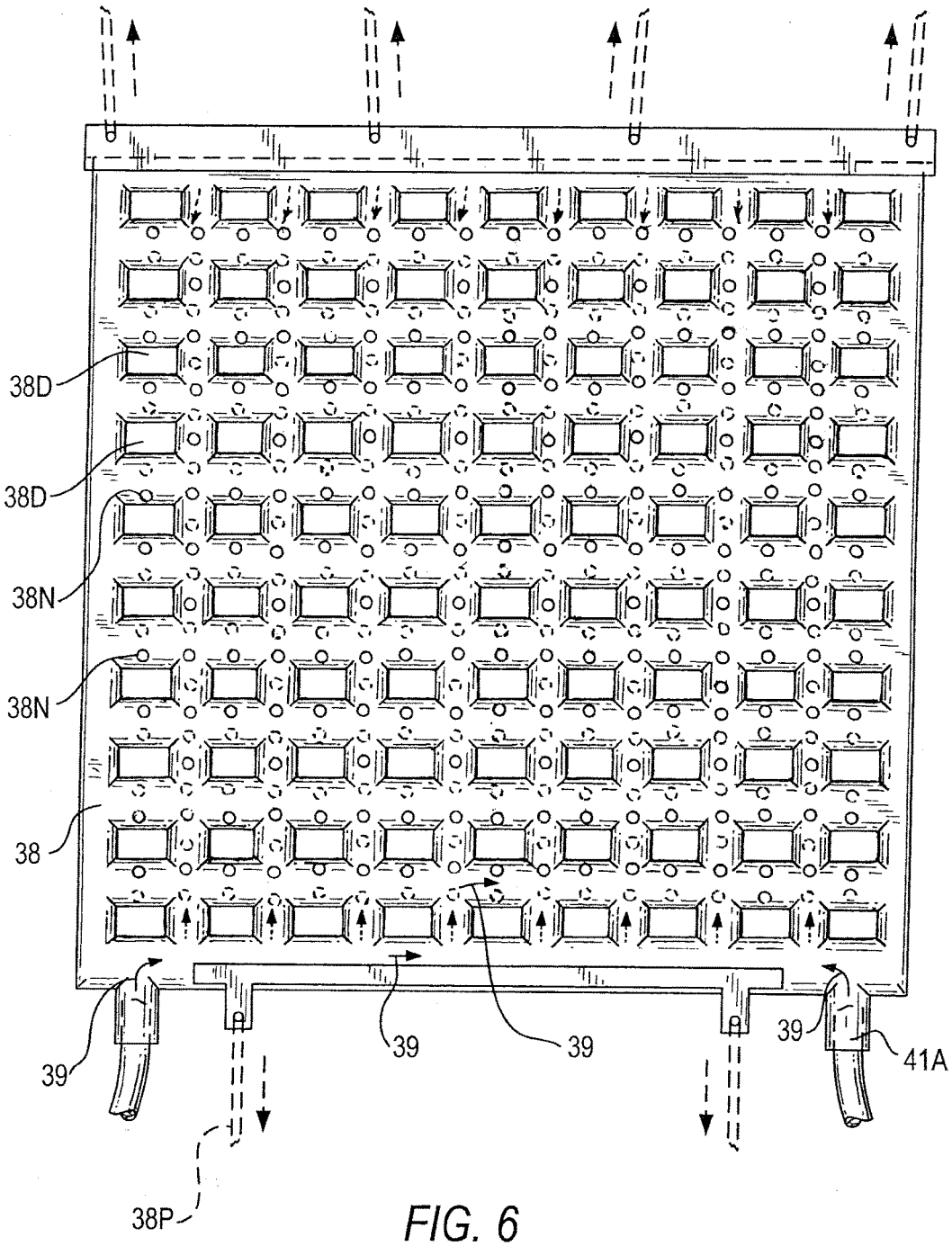
Figure 7:
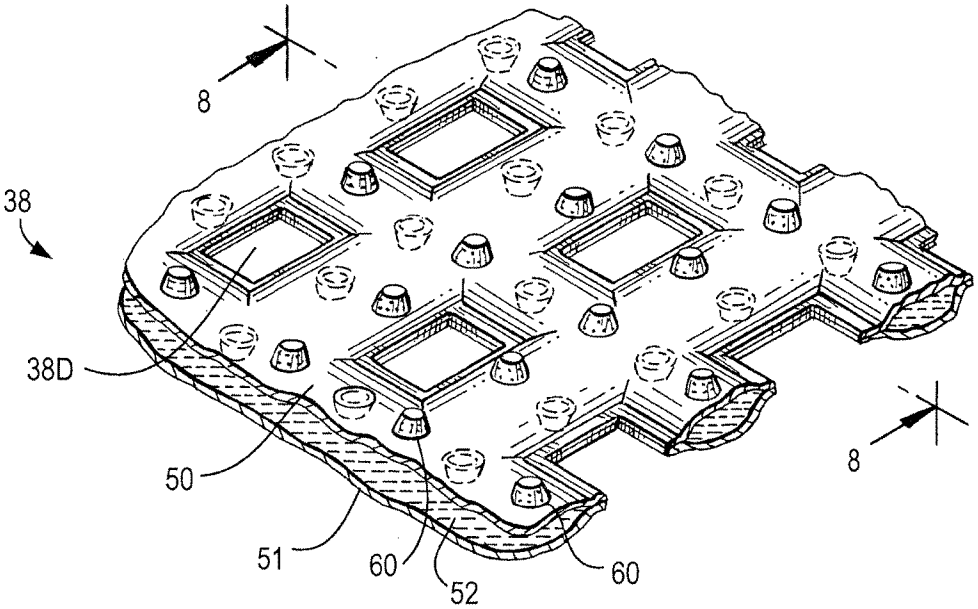
Figure 8:
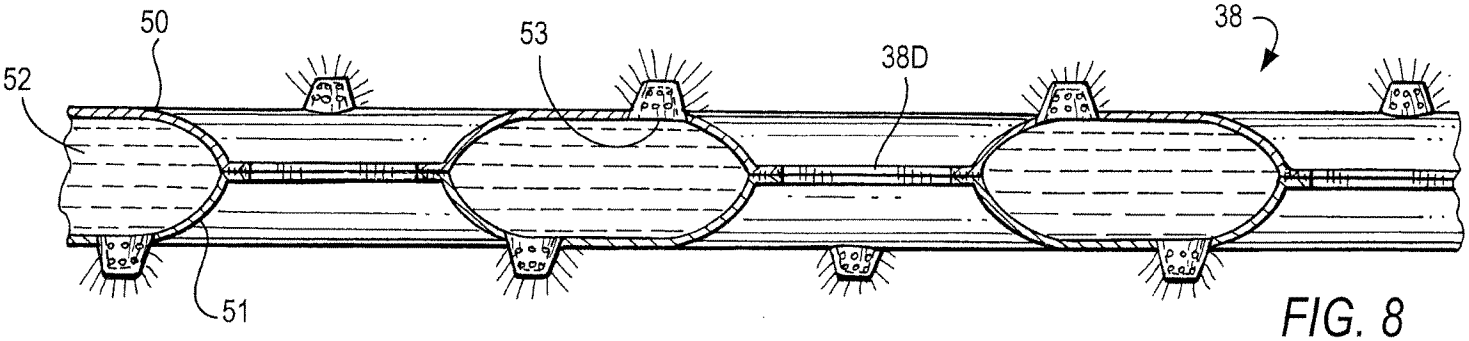

FIGS. 1-10 illustrate a first embodiment of the new invention, and FIGS. 11-14 illustrate a second embodiment. For convenience and clarity similar components in the two embodiments have been given the same reference numbers FIG. 1 is a front perspective exploded view partially cut-away of a prior art air cooled heat exchanger (ACHE), FIG. 2 is a top plan view of the heat exchanger of FIG. 1, FIG. 3 is an elevation view in section taken along line 3-3 in FIG. 2, FIG. 4 is a fragmentary top plan view of an ACHE with a first embodiment of the new cleaning apparatus of this invention, FIG. 5 is a sectional view taken along line 5-5 in FIG. 4 of the heat exchanger and cleaning apparatus of FIG. 4, FIG. 6 is a schematic top plan view of the spray pad of the new invention, FIG. 7 is a fragmentary top perspective view partially in section of the spray pad of FIG. 6, FIG. 8 is a fragmentary view partially in section taken along line 8-8 in FIG. 7, FIG. 9A is a fragmentary sectional view of the spray pad of FIG. 6 showing the spray nozzle, FIG. 9B is a top front perspective view of the spray nozzle of FIG. 9A, shown in its extended state, FIG. 9C is a top front perspective view of the spray nozzle of FIG. 9A, shown in its retreated state.

Figure 9A:
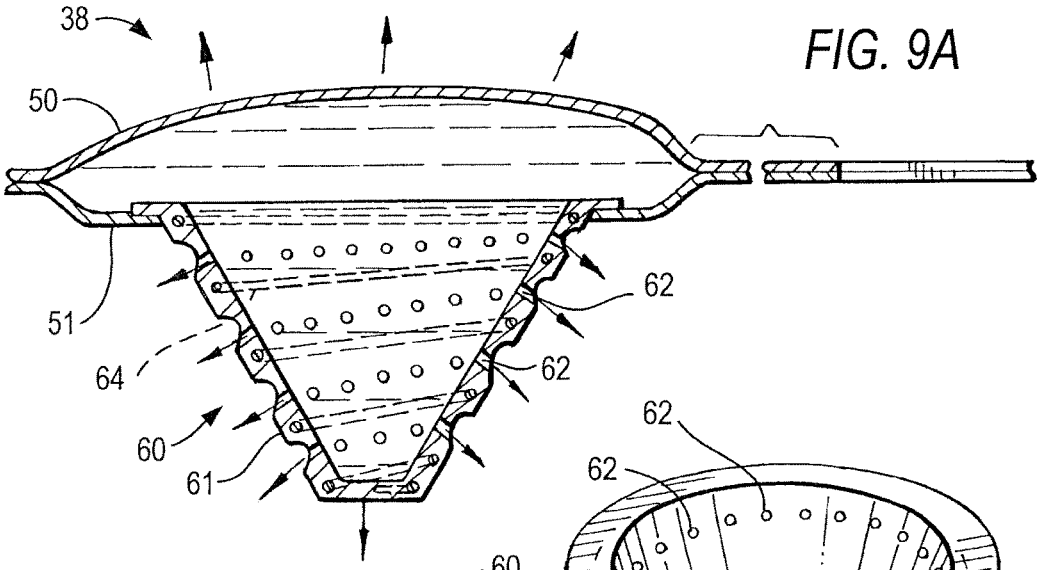
Figure 9B:
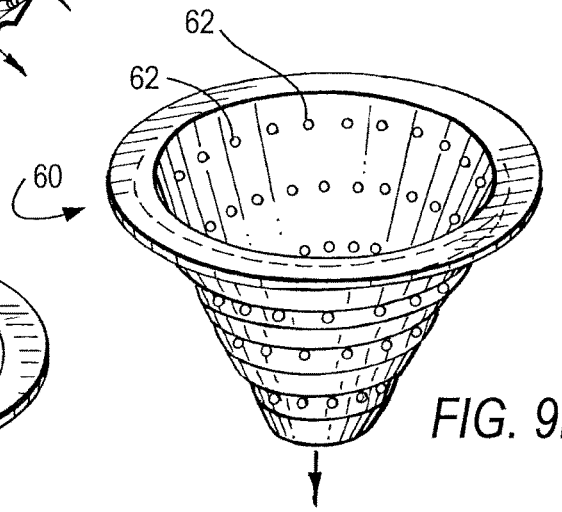
Figure 9C:
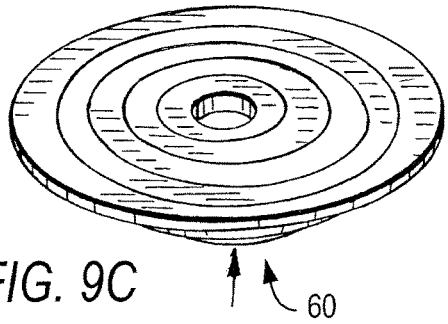
Figure 9E:
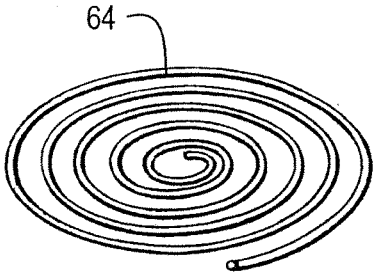
Figure 9D:
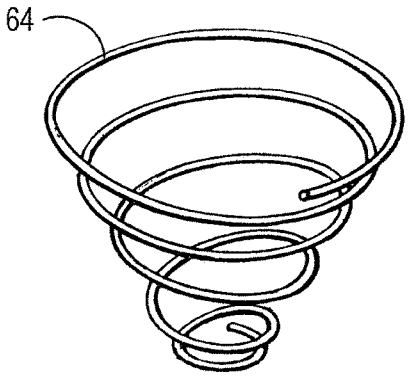
Figure 9G:
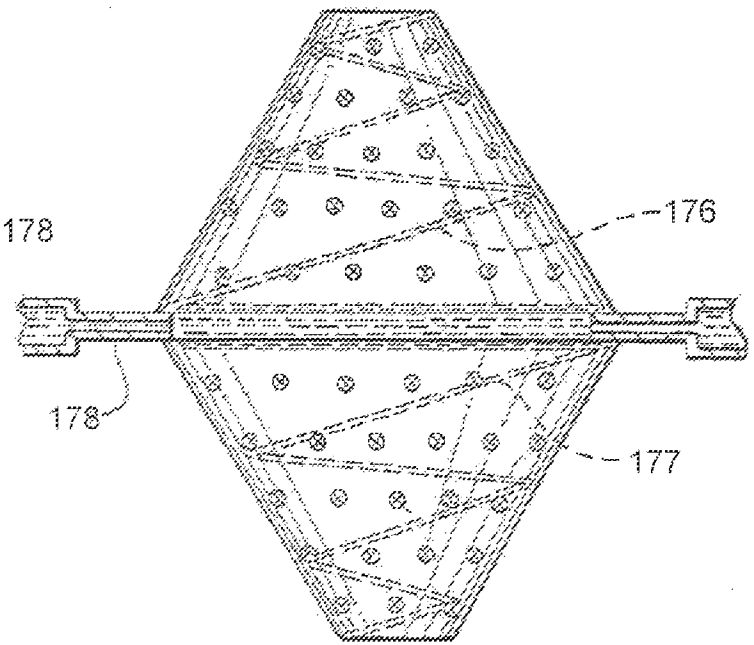
Figure 9F:
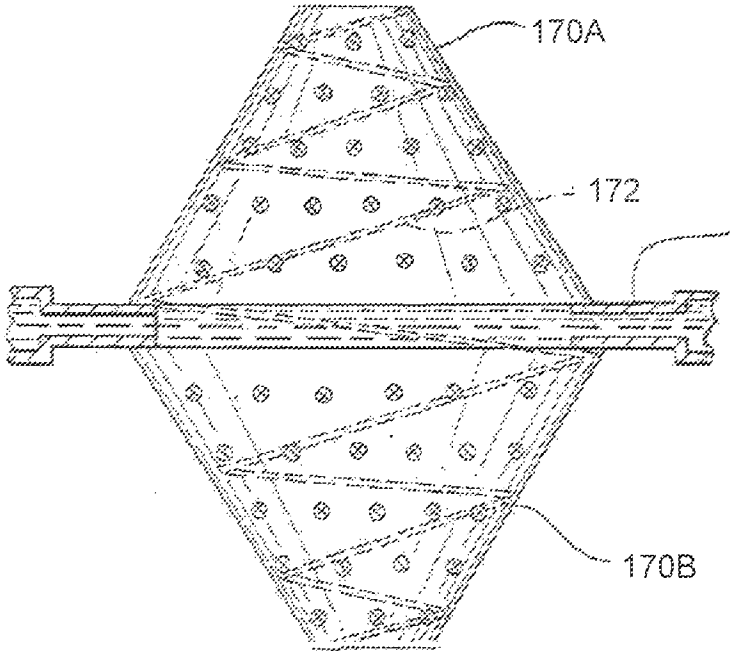
Figure 10:
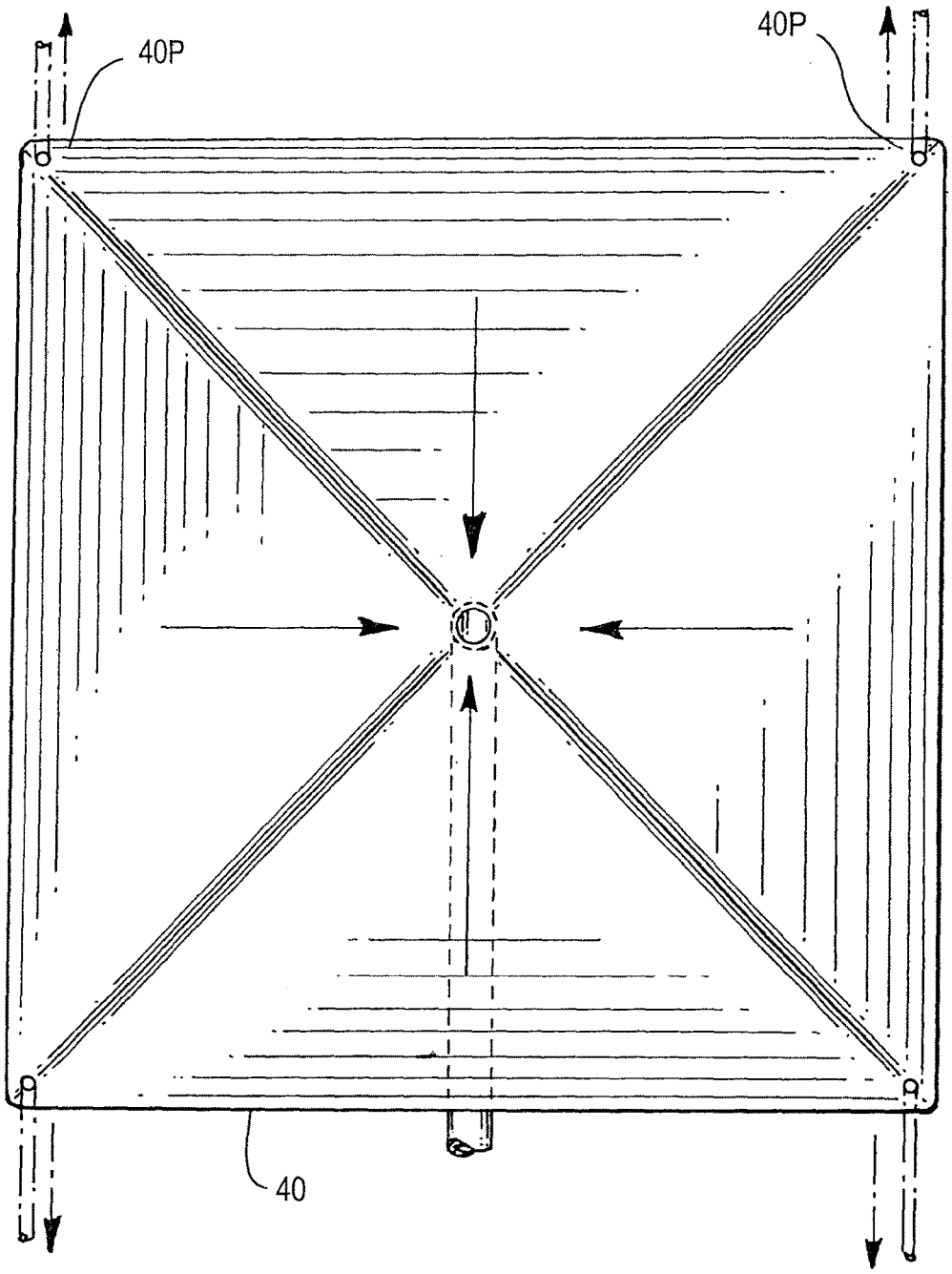
Figure 11:
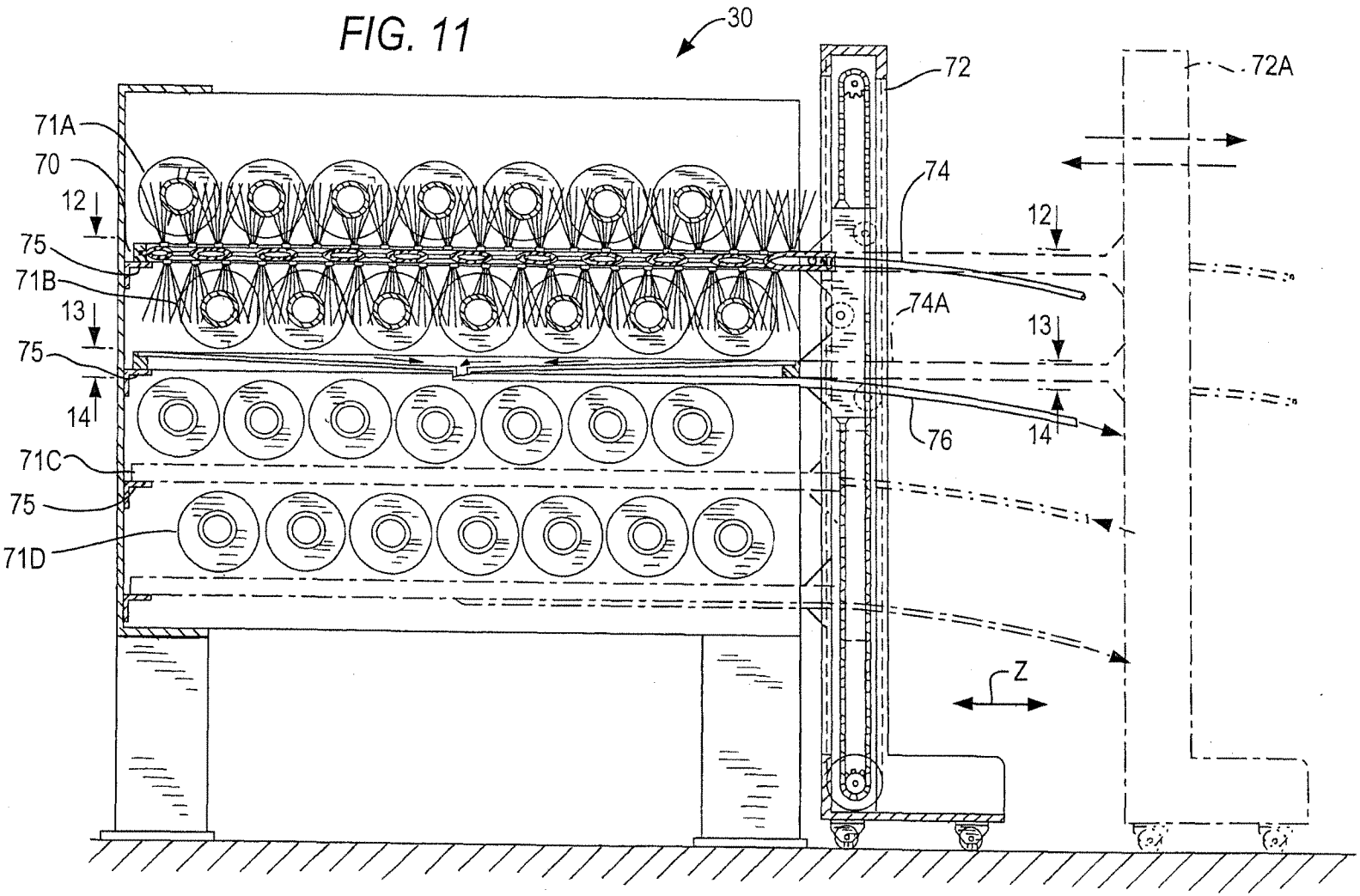
Figure 12:
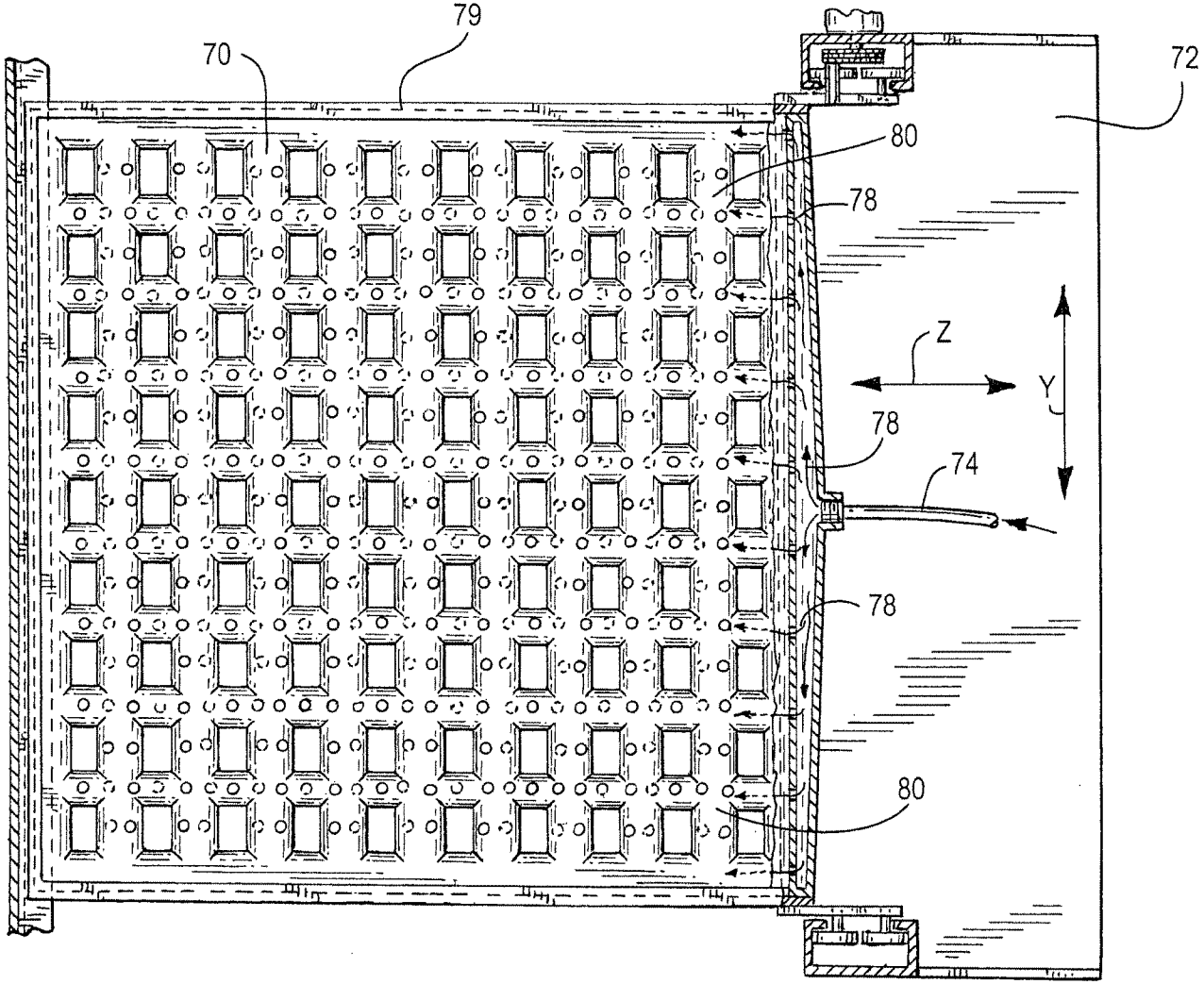
Figure 13:
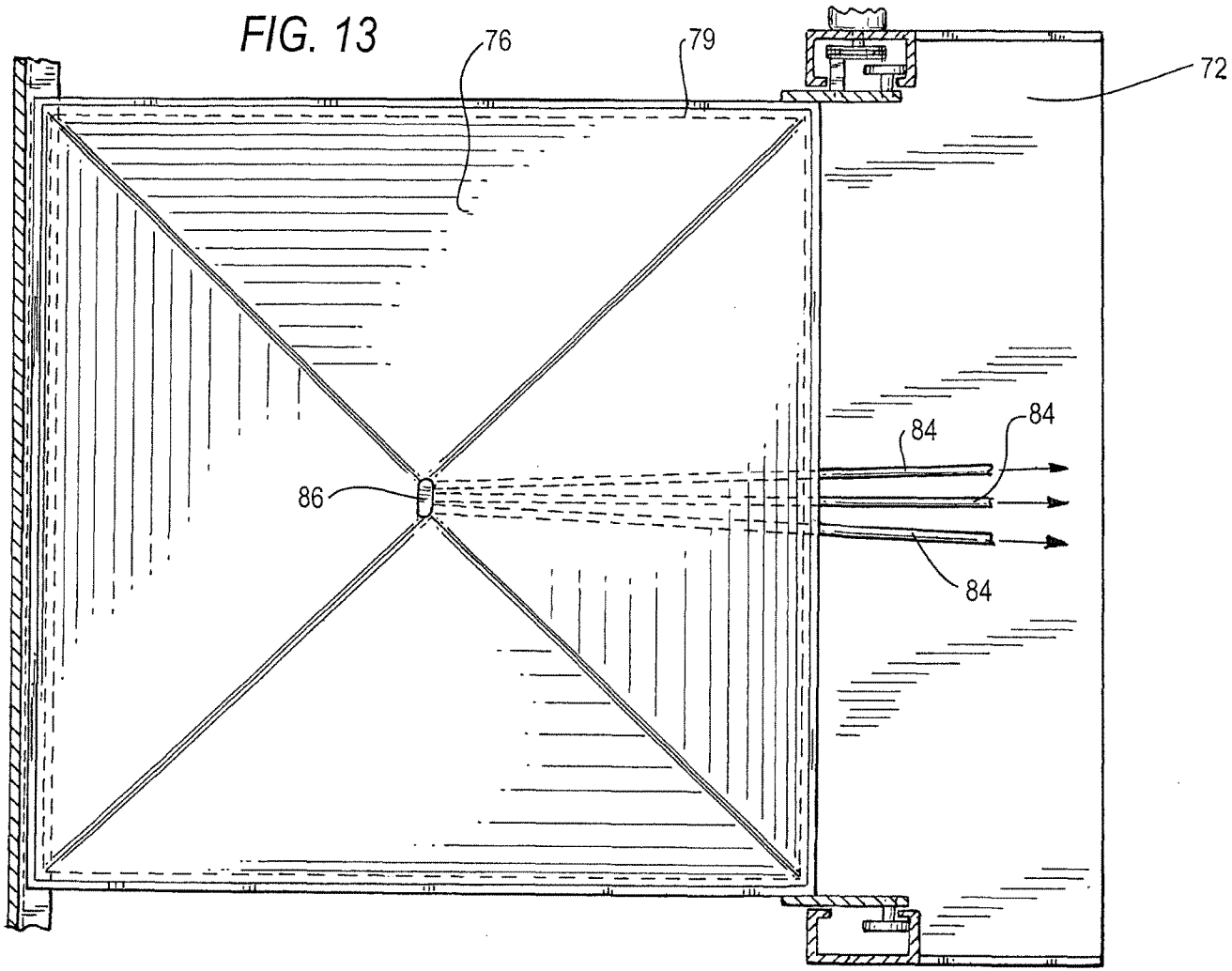
Figure 14:
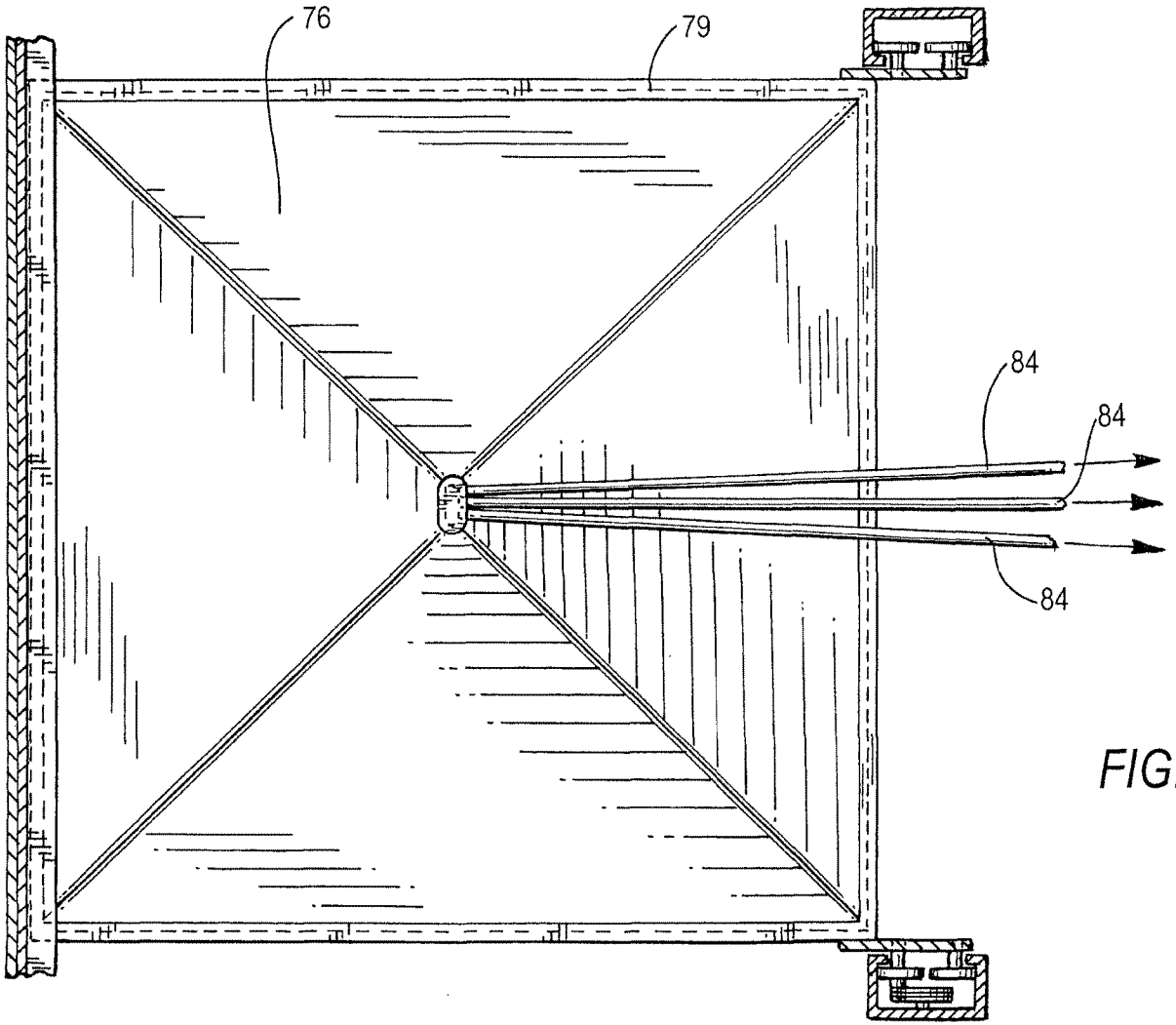
Figure 15:
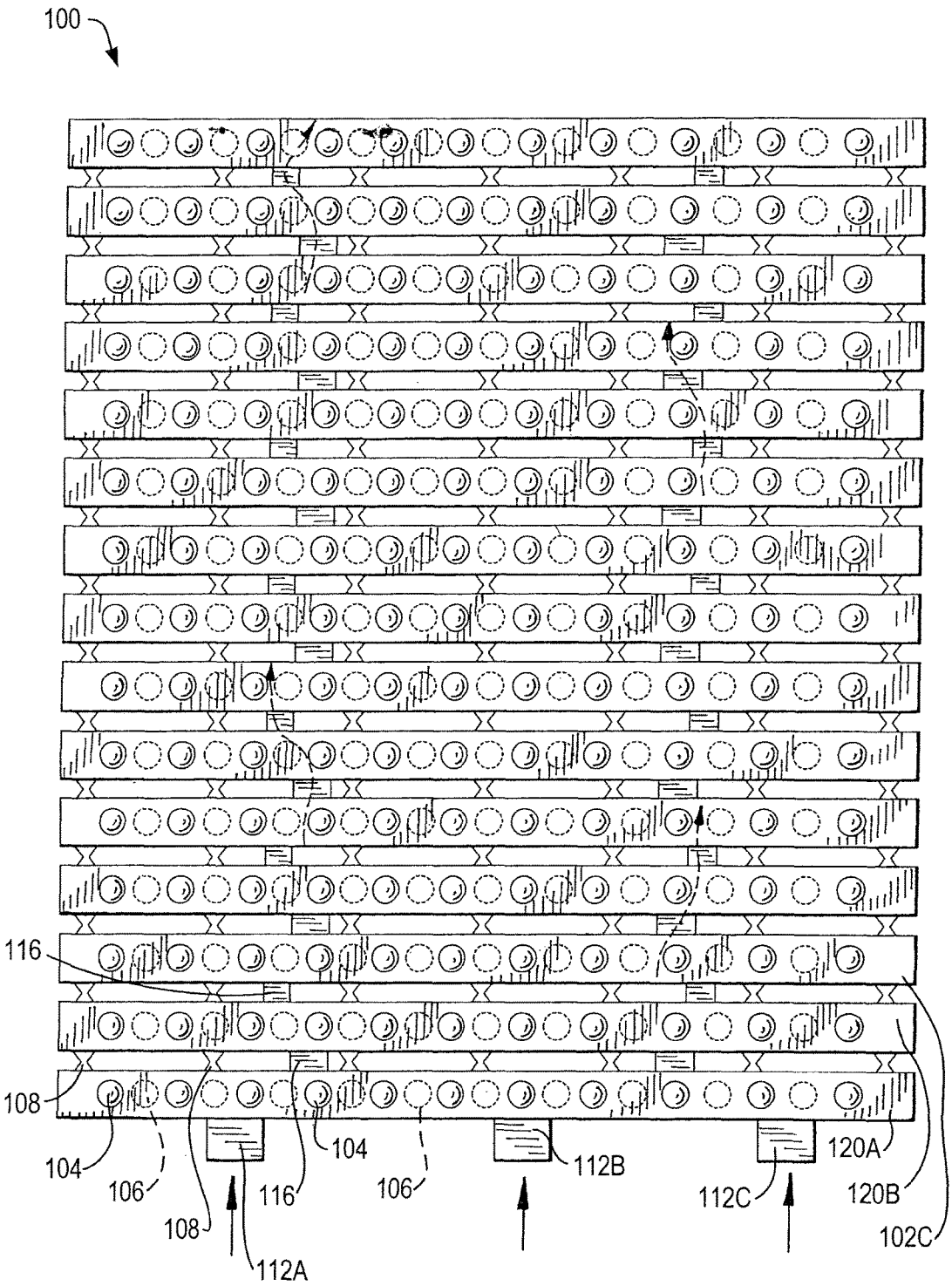
Figure 16:
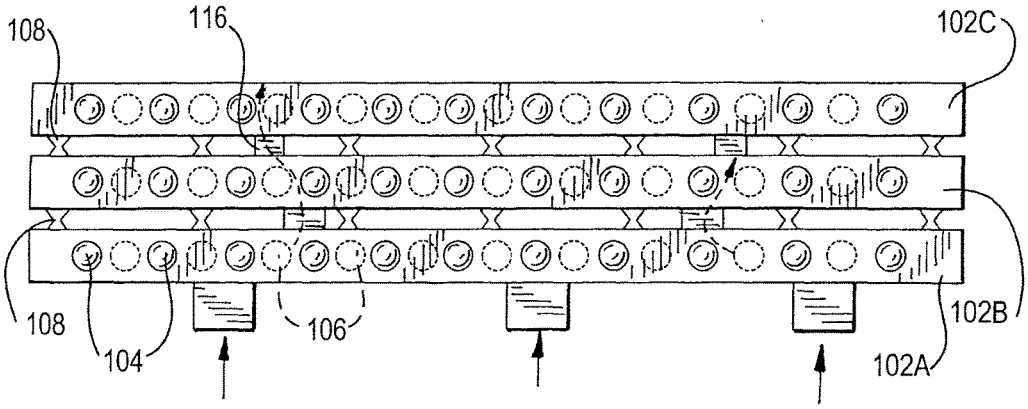
Figure 17:
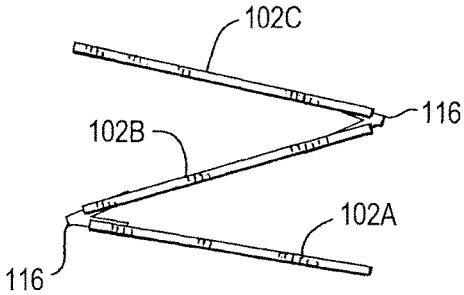
Figure 18:
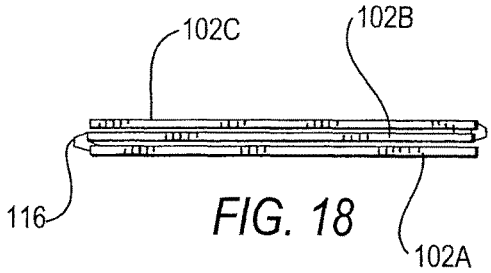
Figure 19:
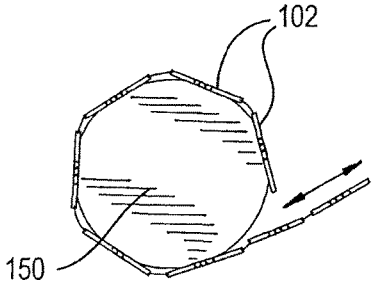
Figure 20:
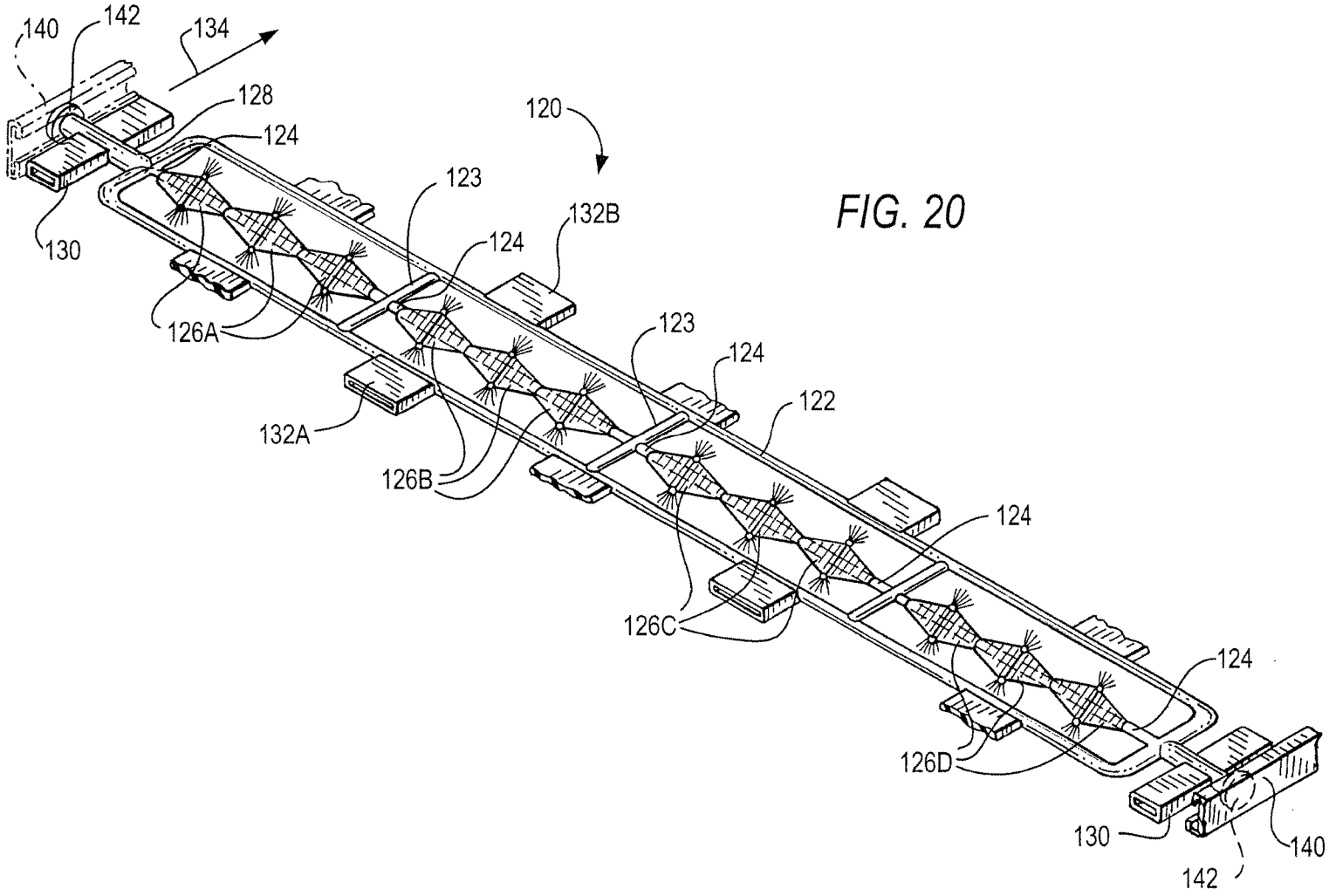
Figure 21:
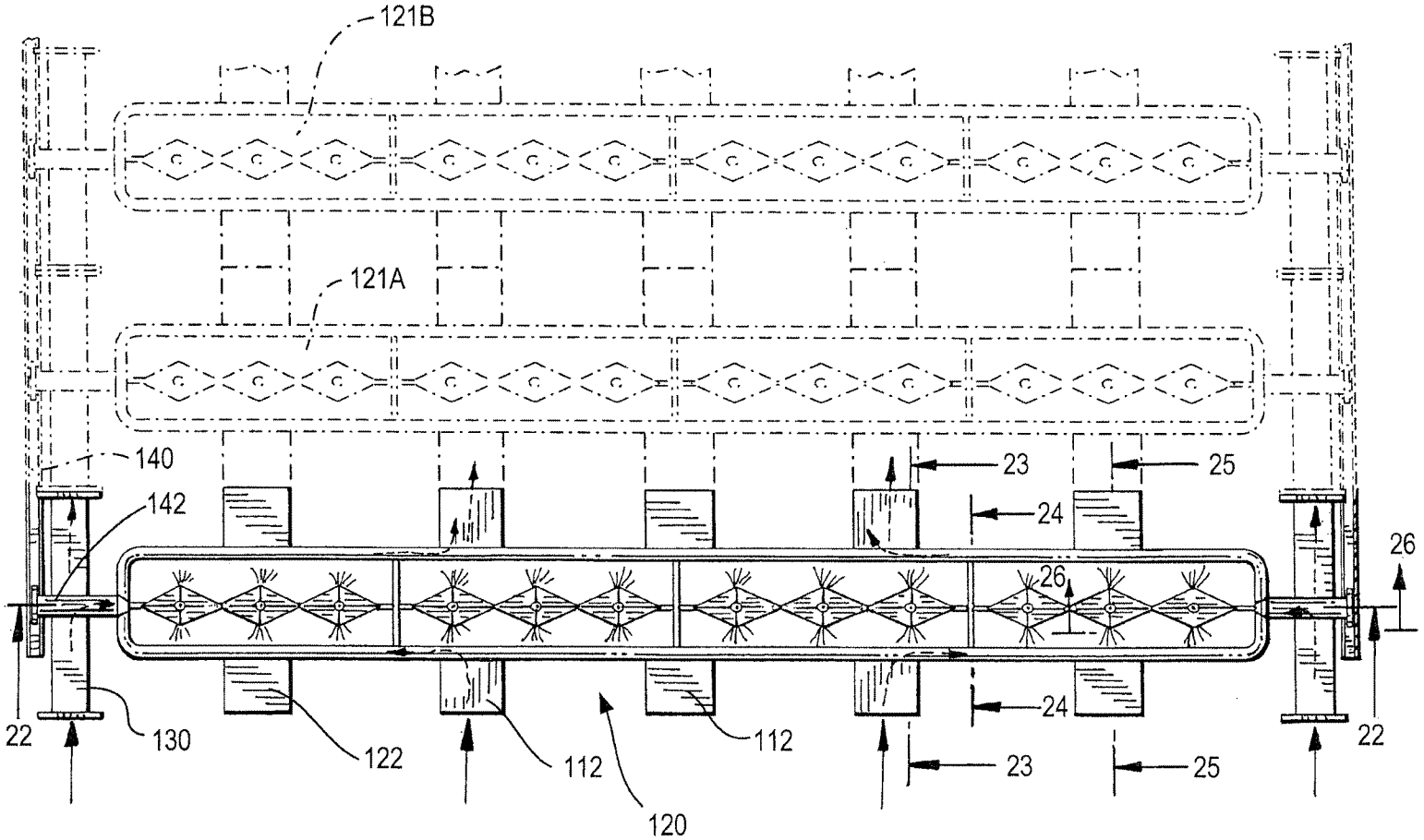
Figure 22:
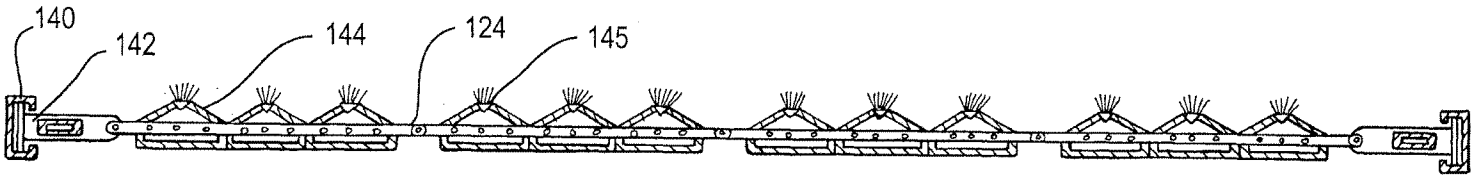
Figure 23:
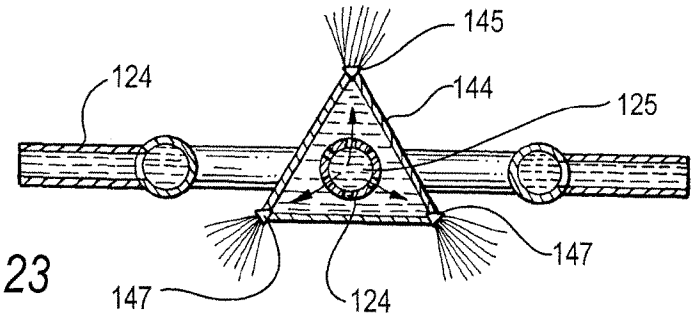
Figure 24:
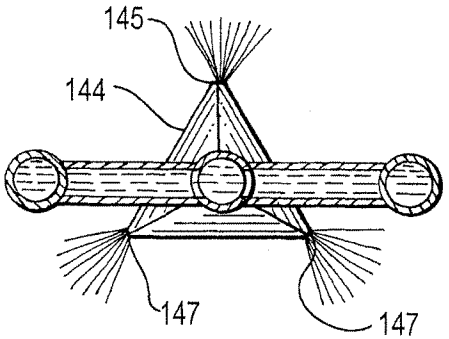
Figure 25:
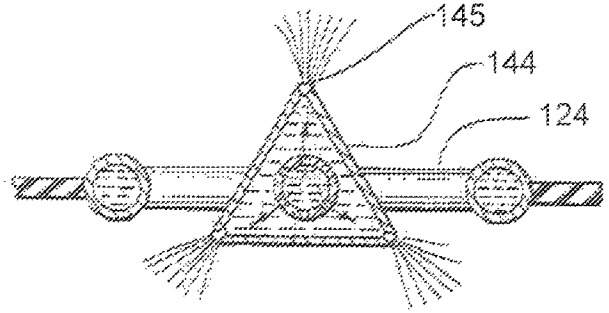
Figure 26:
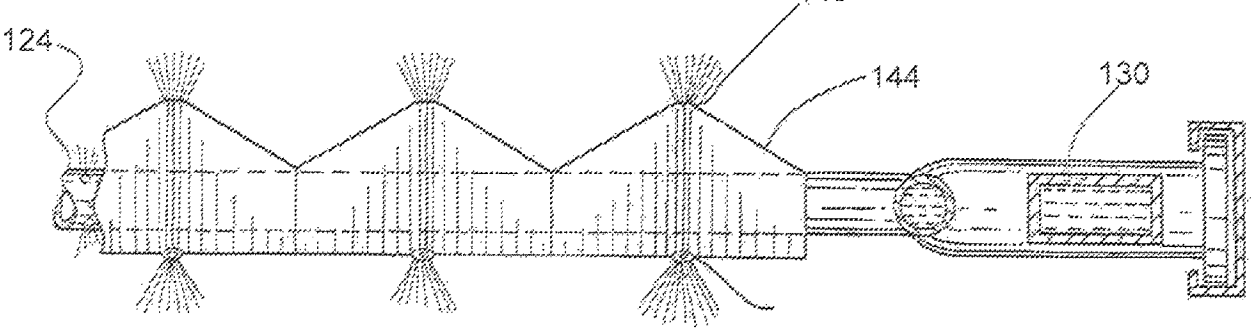
Figure 27:
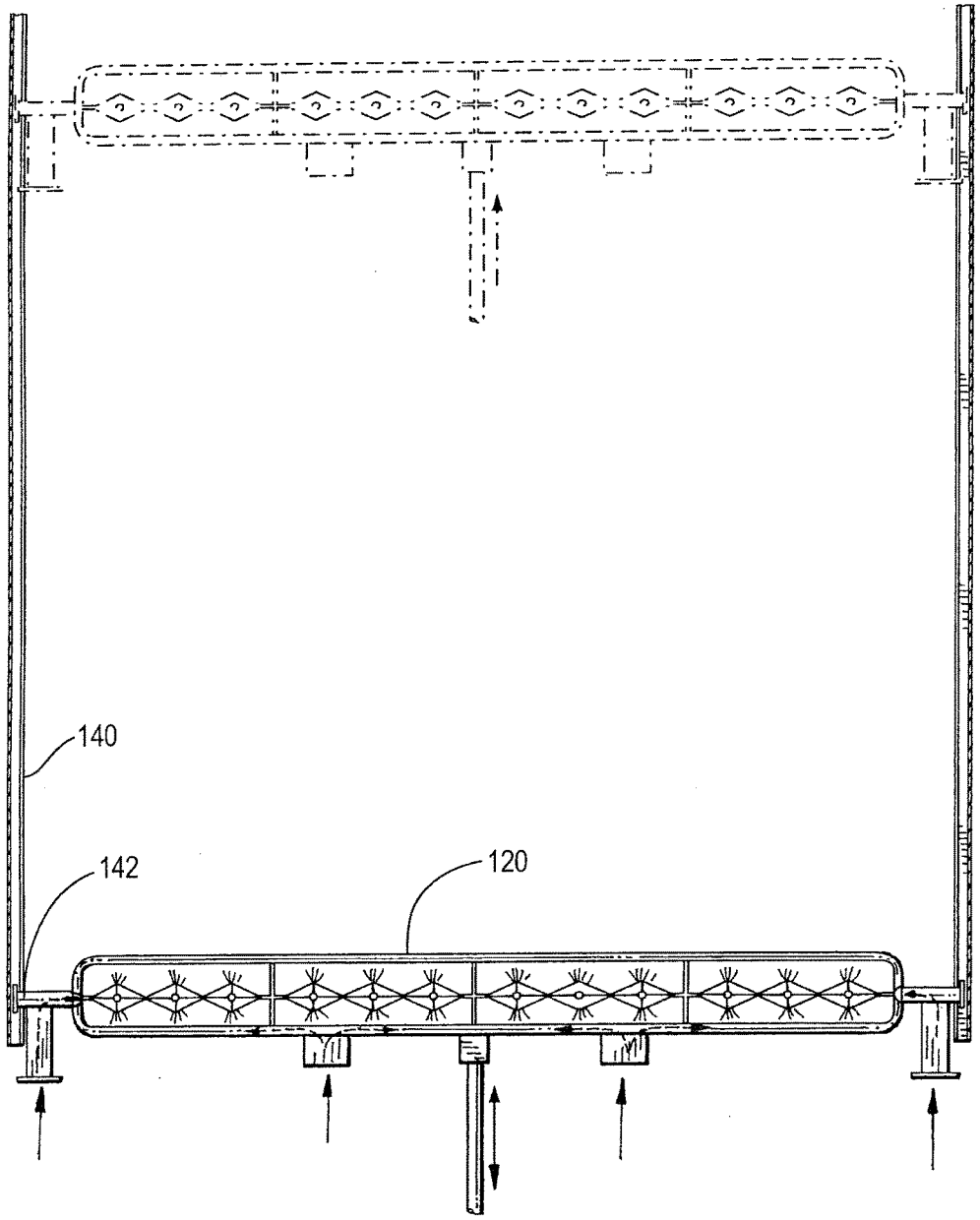
Figure 28:
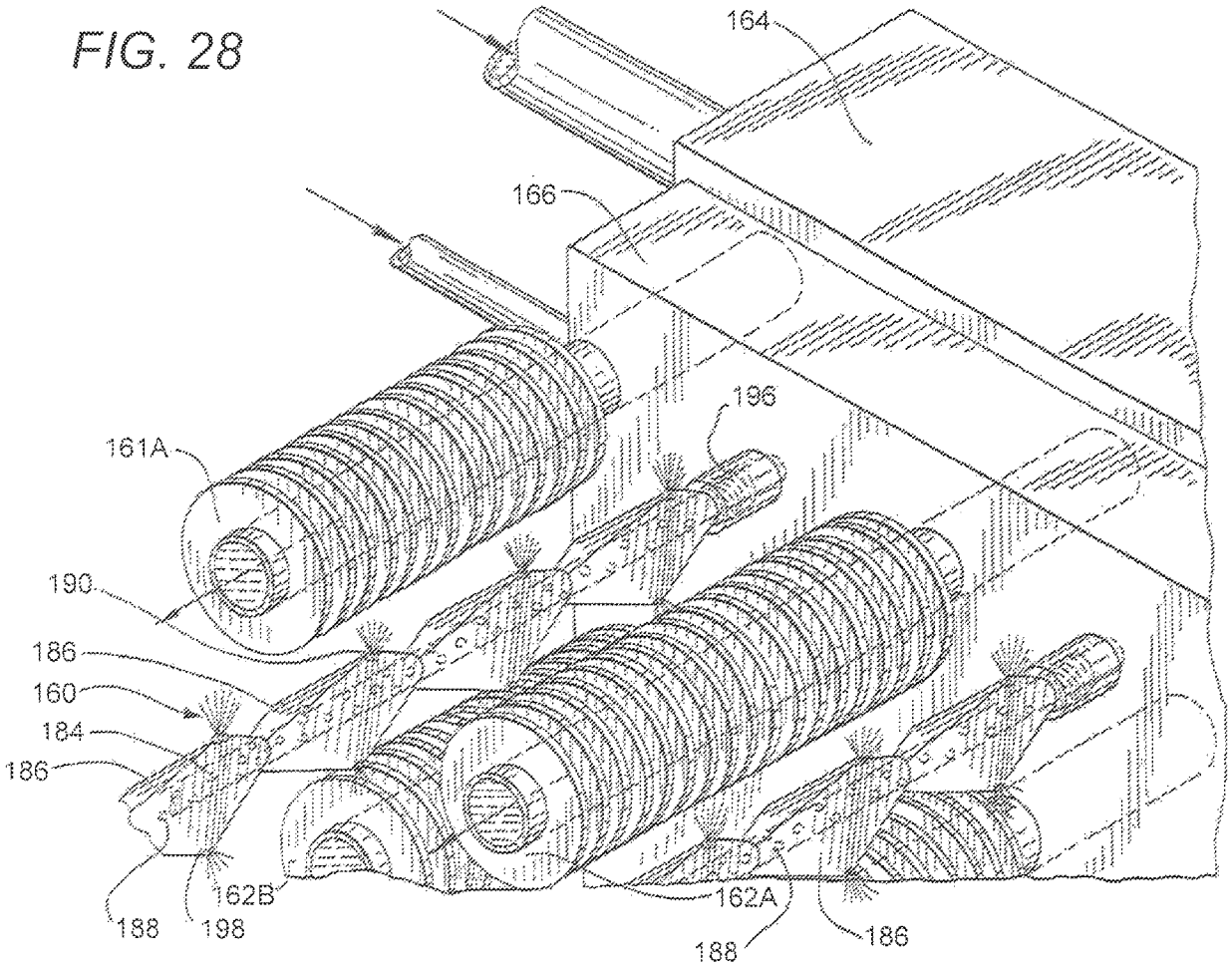
Figure 29:
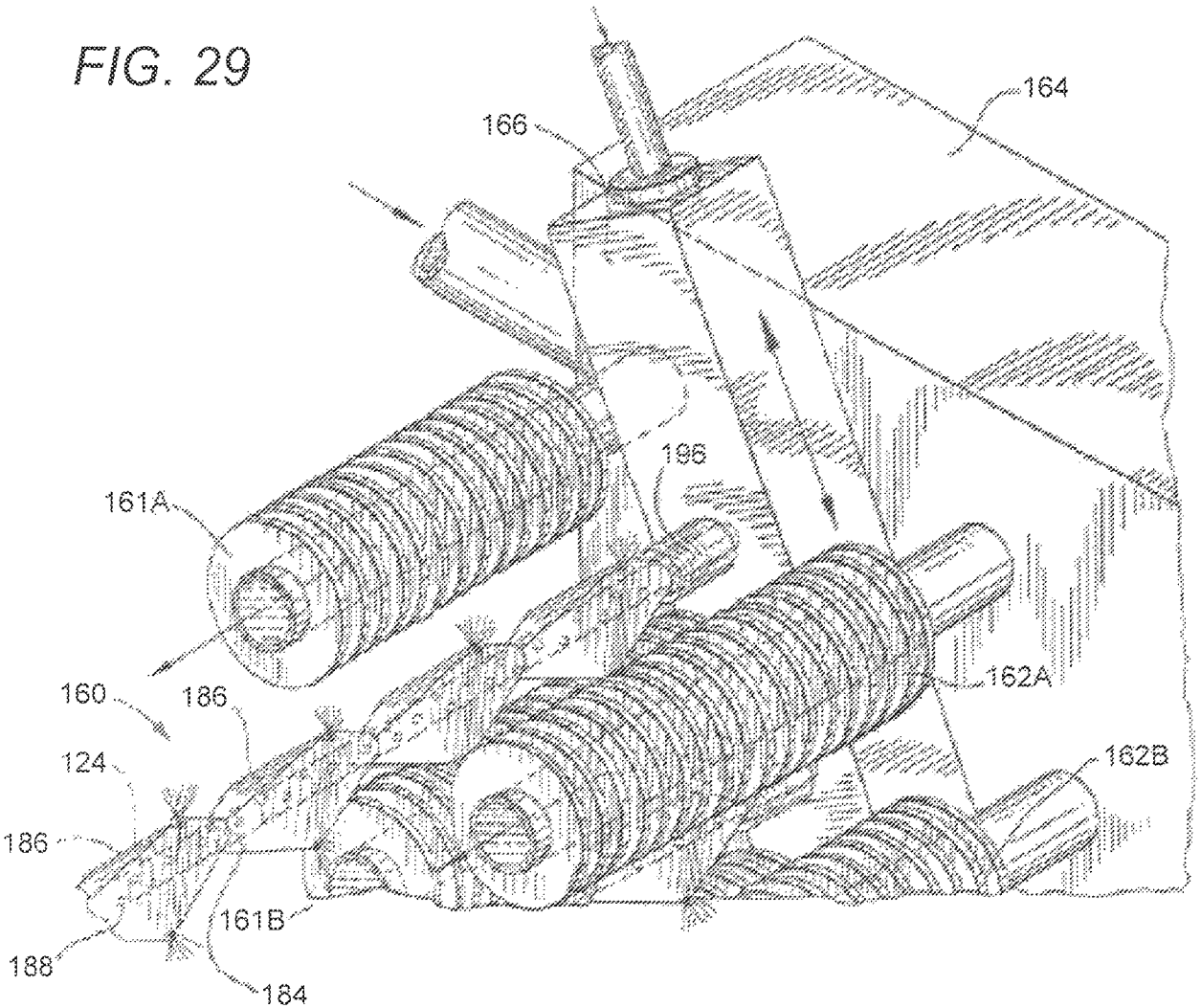
Figure 30:
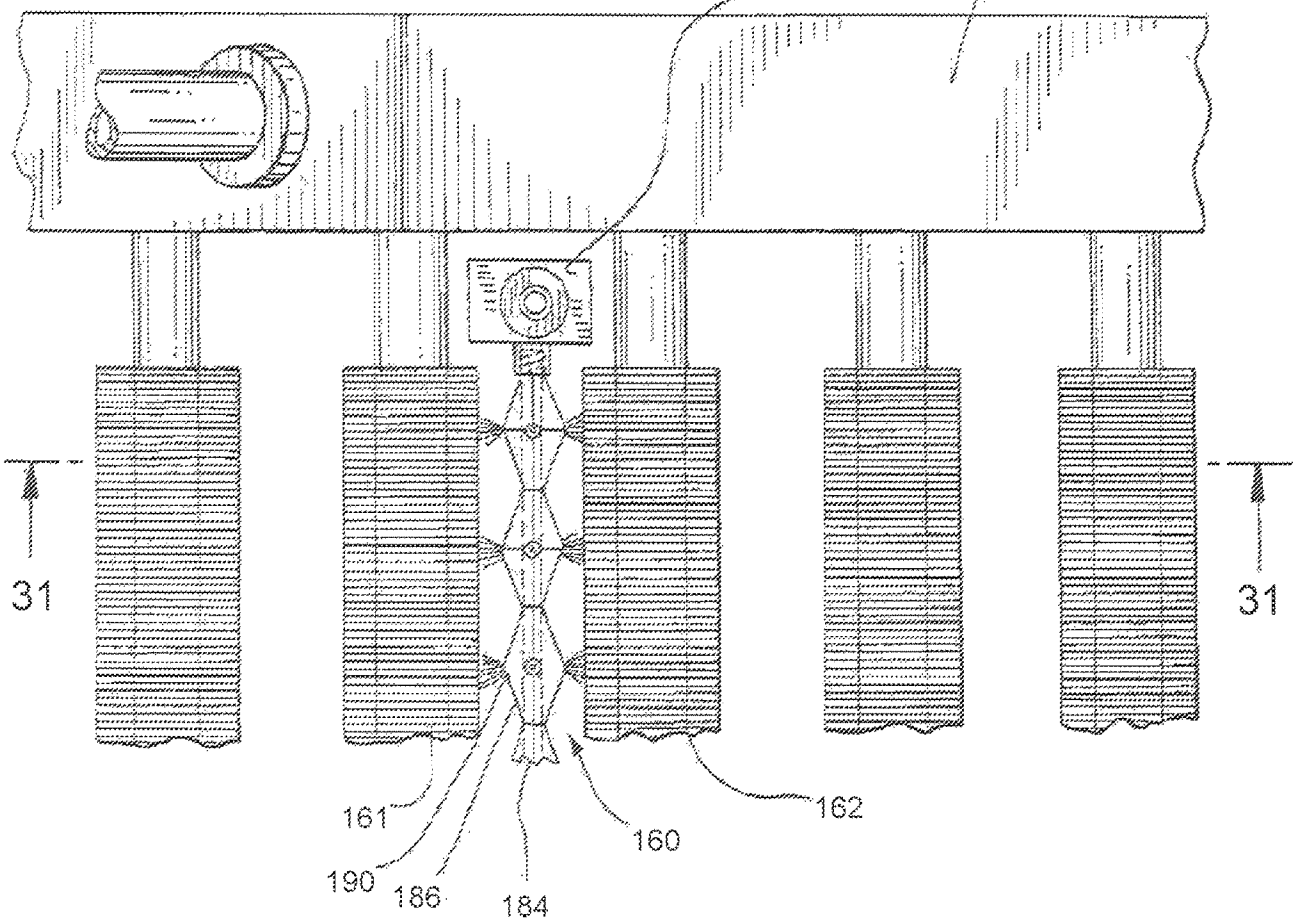
Figure 31:
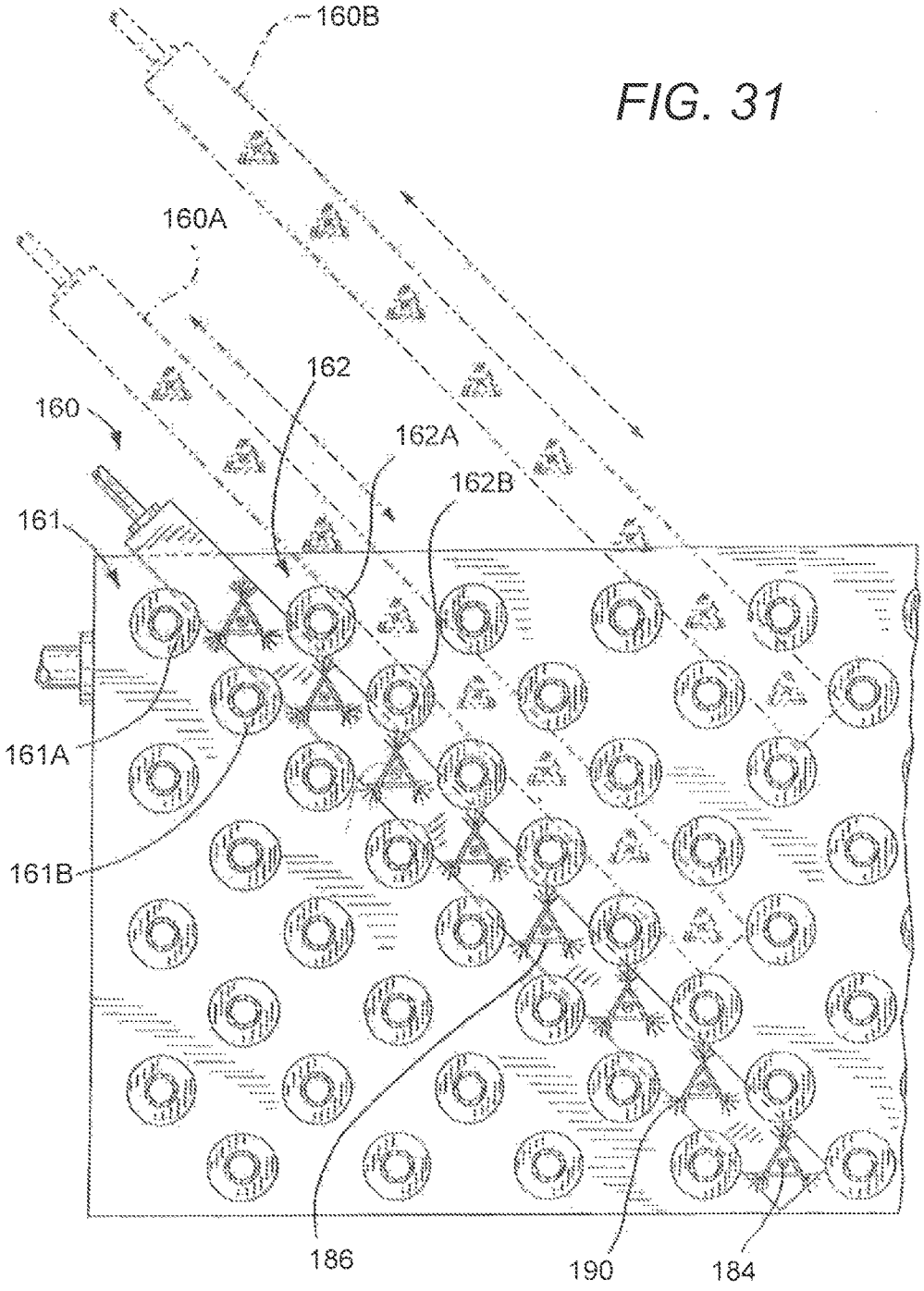

FIG. 9D is a top front perspective view of the nozzle spring of said nozzle in its extended state, FIG. 9E is a view similar to FIG. 9D showing the nozzle spring in its retracted state, FIG. 9F is a fragmentary view partially in section of a conical expandable spring-biased spray nozzle having a single spring applied to both upward and downward spray heads of said nozzle, FIG. 9G is a fragmentary view partially in section similar to FIG. 9F of a conical expandable spring-biased spray nozzle having dual springs for upward and downward spray heads, FIG. 10 is a plan view of a collection pad, FIG. 11 is an elevation view in section similar to FIG. 5 showing a second embodiment of the new cleaning apparatus, FIG. 12 is a schematic top plan view of the spray pad associated with the cleaning apparatus of FIG. 11, FIG. 13 is a top plan view of the collection pad associated with either cleaning apparatus of FIG. 4 or 11, FIG. 14 is a bottom plan view of the collection pad of FIG. 13, FIGS. 15-27 illustrate alternate embodiments of spray mats for the present invention, where FIG. 15 is a top plan view of a first embodiment of an exemplary spray mat comprising a plurality of spray strips (also called spray panels) that are fluid coupled to receive cleaning fluid from a source and to discharge said cleaning fluid out of the multiple spray nozzles in the various spray strips, FIG. 16 as a top plan view of a spray mat similar to that of FIG. 15 but comprising only three spray strips, FIG. 17 is an end elevation view of the spray mat of FIG. 16 showing the three spray strips partially folded toward a storage state, FIG. 18 is an end elevation view of the spray mat of FIG. 16 shown in a fully folded storage state, FIG. 19 as an end elevation view of the spray mat of FIG. 15 shown rolled onto a roller for storage, FIG. 20 is a top perspective view of a further embodiment of a spray strip, FIG. 21 is a fragmentary top plan view showing the spray strip of FIG. 20 in solid line and two spray strips in dashed line indicating different positions of this spray strip when moved laterally in tracks or guides of a heat exchanger, FIGS. 22, 23, 24, 25 and 26 illustrate details of the spray nozzles of the spray mat of FIG. 21, where FIG. 22 is an elevation view in section taken along line 22-22 in FIG. 21 of a single spray strip, FIG. 23 is a fragmentary elevation view in section taken along line 23-23 in FIG. 21 showing a single spray nozzle, FIG. 24 is a fragmentary elevation view in section taken along line 24-24 showing the fluid flow duct between spray strips, FIG. 25 is a fragmentary elevation view in section taken along line 25-25 in FIG. 21, FIG. 26 is a fragmentary elevation view partially in section taken along line 26-26 in FIG. 21, FIG. 27 is a top plan view partially in section and similar to FIG. 21, showing a spray panel of FIG. 19 transversely movable in guide tracks, FIGS. 28-33 illustrate additional embodiments of spray strips, where FIG. 28 is a fragmentary perspective view of spray strips fluid coupled to a manifold, all mounted in a heat exchanger, FIG. 29 is a fragmentary perspective view similar to FIG. 28, but showing spray strips and their manifold forming a rack that is slidable into a space between adjacent rows of heat exchange tubes, FIG. 30 is a fragmentary plan view showing a spray strip situated in the space (tube-pitch) between heat exchange tubes in a heat exchanger, FIG. 31 is a fragmentary sectional view taken along line 31-31 in FIG. 30 showing the manifold position and orientation behind the header, and the spray strips with multiple spray nozzles positioned in the tube-pitch between the heat exchange tubes, FIG. 32 is a fragmentary plan view showing the spray strips and a manifold mounted in the heat exchanger, FIG. 33 is a fragmentary elevation view taken along line 33-33 in FIG. 32 of the heat exchanger showing spray strips situated between heat exchange tubes.

Figure 34:
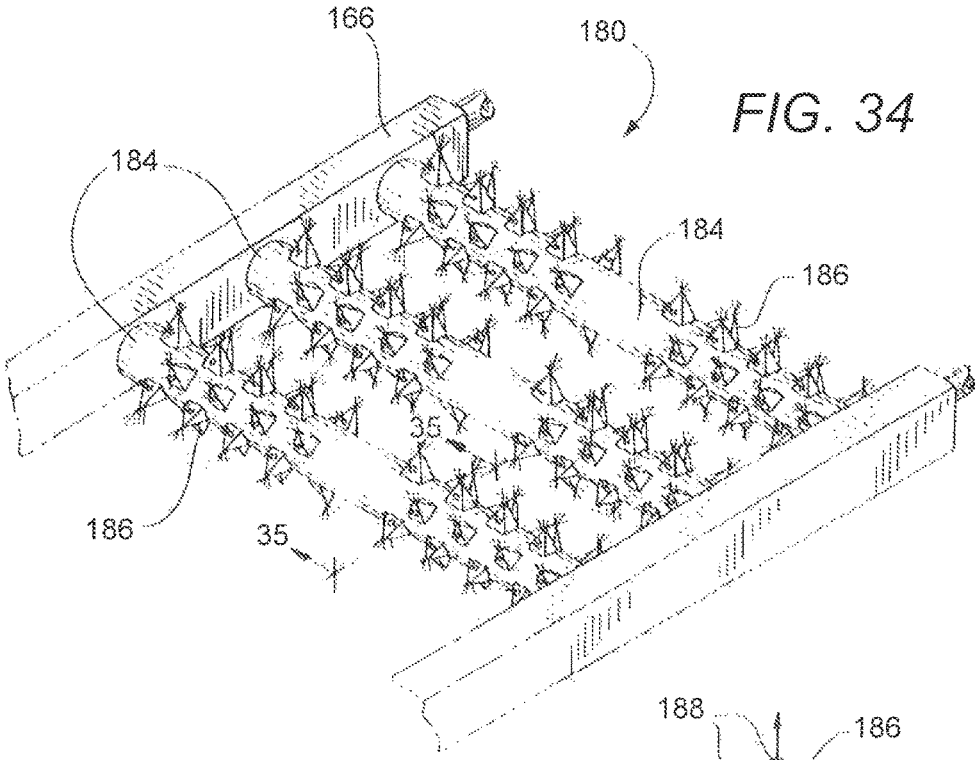
Figure 35:
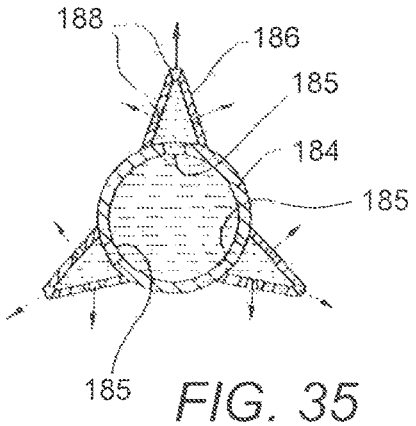
Figure 36:
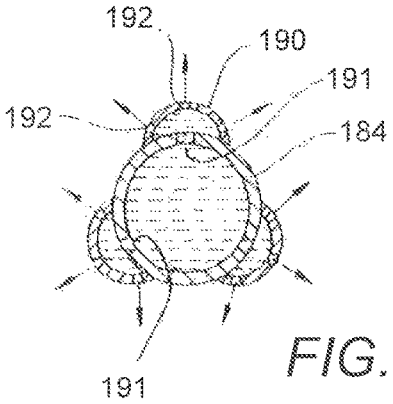

FIG. 34 is a fragmentary perspective view of a spray strip assembly as seen, for example, in FIG. 29 if slidable or in FIG. 28 if permanently mounted, FIG. 35 is an elevation view in cross-section taken along line 35-35 in FIG. 34 showing a generally pyramidal shaped spray controller nozzles, and FIG. 36 is an elevation view similar to FIG. 35 but showing the spray controller with convex curve shaped spray nozzles.

IV. DETAILED DESCRIPTION OF THE PREFERRED EMBODIMENTS

The present invention is a method and apparatus for cleaning corrosive material, dirt and/or other material accumulated on the outer surfaces of ACHE heat exchanger tubes and accumulated particularly between and about the heat exchanger tube fins that affect the ACHE performance and increase pressure drop across the bundle and accordingly increase the power consumption. FIGS. 1-3 illustrate a conventional ACHE 10 including a header or manifold 12 with inlet 20 and outlet 22, tubesheet 14, and heat exchange tubes 16 within the outer surfaces 18.

Also for seen in FIGS. 1-3 a conventional ACHE has heat exchange tubes situated in rows 24 comprising a tube bundle 26. Cleaning the outer surfaces and fins of these tubes is extremely difficult because most rows of tubes are beneath or hidden by other rows, and because many tubes are packed in relatively compact bundles for design and space reasons. Furthermore, the fins are necessarily thin for heat exchange design reasons and are susceptible to damage if impacted by cleaning equipment. The above problems are multiplied when the ACHEs are in a desert or dusty environment as is the case with applicant's many gas and petroleum processing plants.

FIG. 4 shows in a top plan view a general layout of an ACHE 30 operable with the new tube cleaning apparatus. FIGS. 5 and 6 show further structural details of the new tube cleaning apparatus 37 with a heat exchanger 30, its header 12, inlet 20 and tube bundle 34 of heat exchange tubes arranged in rows (see FIG. 5), namely top row of tubes 34A, second row down of tubes 34B, next row below that 34C, etc. Shown schematically are thin fins 35 on the external surfaces of the heat exchanger tubes.

As seen in FIGS. 5 and 6 the cleaning apparatus 37 comprises (a) a spray mat 38 formed of top and bottom sheets defining between them fluid passageways, and (b) a sink or collection sheet 40 that collects the soiled cleaning fluid and directs it away from the tube bundle. Spray mat 38 has a plurality of spray nozzles 38N distributed on its upper and lower surfaces to spray upward and downward respectively. Interspersed between spray nozzles 38N are a plurality of drain holes 38D through which cleaning fluid particularly soiled cleaning fluid dripping back down onto spray mat 38, can pass through the mat and onto the collection sheet or sink 40 below. The construction and function of these nozzles will be described later in connection with FIGS. 9A-9D.

As seen in FIG. 6 (and generally similarly in FIG. 12), cleaning fluid is applied from a source (not shown) via a flexible tube 41A to an inlet 41B in a side edge of spray mat 38. This fluid flows through channels in the interior of spray mat 38 to the above-mentioned spray nozzles 38N. The soiled cleaning fluid that drips downward from "cleaned" row 34A tubes onto the top surface of spray mat 38, drips through drain holes 38D, then drips onto collection mat 40 which is generally concavely curved or inclined downward in its center, to drain hole 40A (FIG. 5) and drain duct 40B which discharges the soiled fluid away from the tube bundle.

An object of the present invention is to provide an apparatus and method that can deliver cleaning fluid sprayed from above and below the rows of heat exchanger tubes, in a way that has not previously been possible. As opposed to prior art methods which merely spray from the top downward into the whole tube bundle or from the bottom upward, and thus fail to spray directly onto the many tubes inward of the exposed outer rows of tubes. The new spray mat is thin enough to be pulled into the generally planar space between each two adjacent rows and to be positioned closely adjacent substantially all of the exposed upper and lower surfaces of said heat exchange tubes in each row of tubes.

As seen in FIGS. 5 and 4, spray mat 38 can be stored on roller 38R which is carried by a transport mechanism 42. Later, spray mat 38 can be pulled off roller 38R and inserted into the space between adjacent rows, which may be between top row 34A and second row 34B (as shown in FIG. 5), or may be between second row 34B and third row 34C, or may be above first row 34A, etc. Spray mat 38 may be pulled in the Y direction (FIG. 4) into such location by a pulling element 38P which may take many alternative forms. Spray mat 38 is subsequently withdrawn from said space by being rolled back onto roller 38R by a roller mechanism on transport mechanism 42.

FIG. 5 shows the transport mechanism 42 positioned along the side edge of the tube bundles 34. This transport mechanism can be moved by drive means 42D in the direction of the arrow X (see FIG. 4) towards the far end of the tube bundle or positions in between. Also, transport mechanism 42 can be moved in the vertical direction of arrow Z (see FIG. 5) to re-position spray mat 38 at appropriate elevations to be inserted between selected rows 34A, 34B, 34C, etc. of heat exchange tubes of the tube bundle 34. FIG. 5 shows spray mat 38 positioned between rows 34A and 34B of heat exchanger tubes, and cooperating collection sheet 40 positioned below row 34D of tubes, with its drain tube 40B extending out of the bottom of collection sheet 40. Also in FIG. 5 is seen roller 38R for withdrawing and rolling up spray mat 38, and roller 40R for withdrawing and rolling up collection sheet 40. These two rollers are mounted on transport apparatus 42 which, as discussed before, can move vertically in the Z direction or transversely in the X and Y directions.

FIGS. 6, 7, and 8 illustrate the structure of the spray mat 38 which comprises (a) upper sheet 50 and lower sheet 51 sealed together in selected areas, and not sealed and other areas, to define fluid flow ducts 52, (b) a multiplicity of spray nozzle openings 53 on top and bottom surfaces where each spray opening communicates with a fluid flow duct, and (c) a spray nozzle 60 associated with each opening 53. The many ducts 52 are fed cleaning fluid by one or more inlets 41B as seen in FIG. 6. An alternate method of providing fluid to the spray nozzles would be to have small tubes distributed over the top or bottom surface of the spray mat, instead of having ducts formed by a pattern of sealed areas between the top and bottom sheets forming the mat.

Spray mat 38 also has a plurality of through holes 38D which serve as the previously described drain holes for fluid to drip down onto and through spray mat 38, and thence to be collected by collection sheet 40 below.

FIGS. 9A-9E illustrate one of the many spray nozzles 60 in spray mat 38. Each spray nozzle is formed by a generally conical piece of flexible material 61 having a plurality of openings 62 which communicate with the above-mentioned fluid channels 52.

In this preferred embodiment it is desired that the nozzles have a normally compressed state as seen in FIG. 9C, and be extendible axially to their extended state as seen in FIG. 9B. Accordingly, the spray mat, when the nozzles are compressed, can be as thin as possible for negotiating it between tight spaces between rows of heat exchange tubes. Then, when cleaning fluid is directed through channels 52 to these nozzles, the pressure of the cleaning fluid will cause the nozzles to pop out into their extended configuration as seen in FIGS. 9A and 9B. Within the flexible material 61 of each nozzle is a coil spring 64, incorporated into the flexible material 61 of the nozzle, where the spring has a normal relaxed and retracted state as seen in FIGS. 9C and 9E. The spring will bias the nozzle to remain in the closed retracted state at all times including during movement of spray mat into or out of spaces between heat exchange tubes and when it is rolled onto roller 38R. However, when spray mat 38 is extended into the space between upper and lower rows of tubes, and when cleaning fluid under pressure is directed through channels 52, the fluid will force the nozzles to pop out into their extended and generally conical shape, so that the holes 62 in the nozzles' conical surfaces, facing many different directions will direct cleaning fluid in a great multiplicity of directions and will clean the maximum area of the heat exchange tubes and the fins thereof.

FIGS. 9F and 9G illustrate alternate expandable spring-biased nozzle configurations that may be used with various spray apparatus disclosed herein. In FIG. 9F there is a single spring 66 extending into both spray nozzles 65 which are supplied by fluid in duct 68. In FIG. 9G there are two separate springs 67A and 67B.

Also seen in FIGS. 7 and 8 are drain holes 38D (can be circular or rectangular) extending between top and bottom sheets 50, 51 of the spray mat 38. These drain holes extend through the mat in areas that are otherwise seal together and thus do not interfere with the joined areas that define the fluid flow ducts.

FIG. 10 illustrates in more detail the collection sheet 40 which is constructed to have or take a generally concave shape, or inclined downward which descends in a central area to its drain hole 40A and drain duct 40B for disposing of soiled cleaning fluid that has dripped onto the top surface of collection sheet 40. At corners or other edges of collection sheet 40 are apertures 40P or other means for engaging and pulling collection sheet 40 into the space between, above or below rows of heat exchange tubes and then back out and on onto roller 40R. Collection sheet 40 may be constructed to have a memory to take the above-mentioned concave or inclined shape after it is expanded, or it may have elastic members which form the mat into the above-mentioned shape after it is positioned in its fluid collection capacity.

As seen in these illustrations of the preferred embodiment, the new ACHE tube cleaning apparatus can be maneuvered into very close quarters between rows of heat exchange tubes in a bundle, which allows cleaning from nozzles positioned very close to the areas to be cleaned, that could never be done before. The results and benefits of this new invention are seen to a greatly enhance heat exchanger operation by rendering the heat exchange apparatus more efficient, by reducing downtime during the cleaning process, by reducing damage to heat exchangers and/or by providing all of the above at a greatly reduced cost as compared to prior art.

FIGS. 11, 12 and 13 illustrate a second embodiment of the present invention, whereby spray mat 30 (that can be rolled up in FIG. 5), is replaced by spray mat 70 that remains generally planar in FIG. 11 and cooperates with heat exchanger 69. This alternate spray mat 70 is supported by transporter 72 which moves in the X direction to withdraw mat 70 from between row 71A and row 71B of heat exchange tubes. Subsequently, transporter 72 can lower and insert mat 70 between row 71B and 71C of heat exchange tubes. This alternate embodiment spray mat 70 may have a peripheral or other frame 79 to maintain its shape, and may utilize supportive guide elements, such as brackets or shelves 75 shown in FIG. 11, While this second embodiment arrangement requires more floor space for transport 72 to move away from heat exchanger 69, it enables a simple fluid connection 74 to the fluid ducts in spray mat 70 which is no longer being rolled up, and enables a simple translation of mat 70 in and out in the X direction, with no requirement for the pulling means 38P and the rollers in the embodiment of FIG. 5.

FIG. 11 further illustrates how transporter 72 in its laterally displaced position indicated in dashed line 72A, can lower spray mat 74 in the Z arrow direction to its partially descended elevation indicated by reference number 74A and insert spray mat 74 between row 71B and row 71C of heat exchange tubes.

With this arrangement a sink or collection sheet 76 can be similarly supported and inserted between rows of heat exchange tubes, or such sink or collection sheet 76 can simply be positioned beneath the lowest row of heat exchange tubes, as in FIG. 5, and removed at the conclusion of cleaning all the rows above FIG. 12 is a schematic top plan view showing the connection of spray mat 70 to transporter 72, and showing the further fluid connection 74 to cleaning fluid that flows as indicated by arrows 78 into fluid flow ducts 80 distributed throughout spray mat 70.

FIG. 13 is a schematic top plan view taken at the elevation of plane 13-13 in FIG. 11 showing collection mat or sink 76 coupled to transporter 72. As stated above, sink 76 could be inserted only at the lowest elevation and kept there until the cleaning between all the rows of heat exchange tubes is completed. FIG. 13 further shows drain tubes 84 leading soiled fluid from central drain hole 86 in sink 76. FIG. 14 shows a bottom plan view of the collection sheet or sink 76 of FIG. 13.

The spray mats 38, 70 and collection sheets 40, 76 respectively of said above referenced first and second embodiments, may be made of various fabrics including nylon and other plastic. The nozzles are can be made of various similar flexible materials, and the coil springs within the nozzles may be made of plastic or metal, preferably materials not susceptible to corrosion or fatigue and obviously selected to have adequate strengths, memory and long life. The transport mechanism including the rollers and pulling means for directing the spray sheet and collection sheet to their desired positions would be made of from typical commercial materials and apparatus.

FIGS. 15 through 27 illustrate various further embodiments of spray mats of the present invention, which can be moved and positioned between two adjacent rows of heat exchange tubes in a heat exchanger, as previously shown in FIG. 5.

FIG. 15 shows spray mat 100 as a first of numerous embodiments, comprising a plurality of spray panels (or spray strips) 102A, 102B, 102C, etc., each of which has upward facing spray nozzles 104 and downward facing spray nozzles 106 shown dashed line. As further seen in FIG. 15, the adjacent spray strips 102 are coupled together by bendable hinges 108 allowing these spray strips to be extended in a flat plane for use in the spray mat mode seen in FIG. 15. FIG. 16 shows a spray mat similar to that of FIG. 15, but having only 3 spray strips fluid and hingedly coupled together.

In the spray mat of FIG. 15 cleaning fluid from a source not shown enters inlets 112A, 112B, and 112C, flows into spray strip 102A where it is distributed to outlet nozzles 104 facing upward and spray nozzles 106 facing downward, with surplus fluid flowing as indicated by arrows 114 through connection ducts 116 into successive spray strips 102A, 10B, 102C, etc. where it is distributed to upward and downward spray nozzles 104, 106 in these spray strips. As indicated by arrows 114 fluid flow continues via connecting ducts 116, into successive spray strips and finally is discharged through their corresponding upward and downward spray nozzles 104 and 106.

Discharged soiled fluid drips downward from this spray mat 100 onto a collection sheet 40 as seen in FIGS. 5, 10, 13 and 14. The collected fluid is drained away. After the spray mat is inserted sequentially into spaces between successive adjacent rows of heat exchange tubes and cleaning is concluded, the spray mat will be withdrawn from between rows of heat exchange tubes and stored. Also the collection sheet will be withdrawn and stored. Details of the internal structure of the spray strip and spray nozzles will be described in subsequent paragraphs.

Each spray strip or spray panel 102A-C in the spray mat 100 of FIG. 15 or FIG. 16 may comprise a tube formed of two layers of sheet material as generally shown in FIGS. 6-8, which tube defines fluid flow channels between the sheets and spray nozzles for fluid flow upward and downward out of such tube.

FIG. 20 illustrates a further embodiment 120 of a spray panel which comprises a tubular frame 122 with crossbars 123 that help support central tube 124 extending lengthwise of frame 122 and along which are spray nozzles 126A, 126B, 126C and 126D. In this particular embodiment spray nozzles 126A receive cleaning fluid from inlet 128 fed by manifold 130 that receives fluid from a source not shown. Spray nozzles 126B are supplied by fluid from inlet 132A fed by a source not shown. Spray nozzles 126C function similarly to spray nozzles 126B, and spray nozzles 126D function similarly to spray nozzles 126A. Fluid into inlet 132A, for example, not only supplies nozzles 126B, but continues via outlet 132B to the next adjacent spray panel and its corresponding spray nozzles. Manifold 130 extends in the direction of arrow 134 to the next adjacent spray panel to supply spray nozzles similarly. Detailed structure of the spray nozzles will be described later. Alternatively, manifolds 130 at opposite ends provide fluid to all the nozzles.

FIG. 21 shows a spray mat like that in FIG. 20 situated in a heat exchanger having tracks 140 in which slide end pieces 142 of frame 122. In this Figure there is a spray panel 120 shown in solid line and spray panels 121A, 121B shown in dashed lines, where the multiple spray panels form a spray mat that is movable transversely, guided by tracks 140, between adjacent rows of heat transfer tubes in a heat exchanger. FIG. 27 illustrates alternatively a single spray panel 120 movable along tracks 140 and to laterally successive locations.

Spray mats formed of multiple spray panels can be stored in a variety of ways as exemplified first by FIGS. 17 and 18 where spray panels can be folded into a compact flat sandwich configuration, and as alternatively illustrated in FIG. 19 where spray mat comprising multiple spray panels can be rolled onto a storage roller 150. These and other storage alternatives would provide safe and convenient storage for such spray mats when removed from the heat exchanger.

As seen in FIG. 21 cleaning fluid through inlets 112 can flow through the tubes comprising the frame of the spray panel and thence into the interior of the multiple spray nozzles. In regard to the spray nozzles of the spray panel of FIG. 21, details are provided in FIGS. 22-26 as follows. FIG. 22 is a sectional view taken along line 22-22 in FIG. 21 showing central tube 124 whose end pieces 142 slide in tracks 140. FIG. 23 which is an end elevation view in cross-section of one of said nozzles 144, shows along the length of tube 124 there are spray nozzles 144 which have upward facing openings 145 and downward facing openings 147, and central tube 124 has additional apertures 125. As further seen in FIG. 23 central tube 124 has optional additional apertures 125 for cleaning fluid from the source to flow in tube 124 through apertures 125 into the interior space 124S of spray nozzle and out of apertures 145. FIGS. 24 and 25 provide further details of nozzle 144. FIG. 26 shows in cross-section the spray mat fluid coupled to manifold 130.

Further embodiments of the present invention are illustrated by heat exchanger 160 in FIGS. 28-34, where an air cooled heat exchanger has a typical row of heat exchange tubes 161A, 161B adjacent another row of heat exchange tubes 162A, 162B, all shown and horizontal orientation. Between these two rows of heat exchange tubes is a diagonal space into which a spray strip apparatus 160, (a) is slidable while coupled to its fluid supply manifold 166 as seen in FIG. 29, or (b) is mounted in a heat exchanger as seen in FIG. 28.

In both alternatives of FIGS. 29 and 28 and as seen in FIG. 30, the cleaning fluid manifold 166 is situated in the space where there is no finning at the ends of heat exchange tubes. Also, in both alternatives the cleaning fluid manifold can be a tube of typical round cross-section instead of the rectangular cross-section shown merely for clarity and convenience. FIG. 31 further illustrates how a spray strip assembly can be inserted diagonally between a row of heat exchange tubes 161A, 161B and adjacent row of exchange tubes 162A, 162B.

In FIGS. 28, 29, 30 and 31 the spray strips 160 are illustrated as spray controllers 186 aligned on an internal tube 184 which has multiple perforations 188 (see FIGS. 28, 29) to deliver cleaning fluid which is subsequently ejected through nozzles 190 distributed at different angles on external surfaces of the spray controllers. Also seen in FIGS. 28-30, the spray controllers 186 are situated in end-to-end relationship along their supply tube which extends lengthwise within the controllers. FIGS. 28 and 29 further illustrate a spring collar 196 situated at each end of a spray strip for urging the spray controllers to remain tightly adjacent end-to-end to each other. In an alternate version however these spray controllers could be welded together and/or welded to the supplied tube within.

FIGS. 34, 35 and 36 illustrate further details of an exemplary spray strip assembly 160 including manifold 166, fluid supply tube 184, and the plurality of spray controllers 186. This assembly of spray strips and manifolds can form a rigid rack that is mounted or removably inserted between adjacent rows of heat exchange tubes.

FIG. 35 shows in cross-section fluid supply tube 184 with apertures 185 for fluid flow to spray controllers 186. These spray controllers have a generally pyramidal shape with its base adjacent the outer surface of said spray controller and its apex extending outward therefrom.

Each spray controller has multiple spray nozzles 188 oriented in different directions so that the plurality of spray controllers with their multiplicity of spray nozzles can provide a vast array of cleaning fluid in all directions as this spray apparatus is either removably inserted between rows of heat exchange tubes or is permanently mounted in a heat exchanger between rows of heat exchange tubes. FIG. 36 is similar to FIG. 35 but illustrates spray controllers 190 having a generally convex curved shape and including apertures 191 through which cleaning fluid flows until it is directed outwardly through spray nozzles 192.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the claims.

The invention claimed is:

1. A spray apparatus for spraying cleaning fluid from a source of cleaning fluid under pressure onto the outer surfaces of heat exchange tubes that extend in rows in a heat exchanger, said rows of 8 exchange tubes being spaced apart from each other with a generally planar space defined between each two adjacent rows of said heat exchange tubes, said spray apparatus formed of a plurality of spray strips situated, each spray strip comprising:

a. a frame, b. a central supply tube mounted in said frame, said central supply tube having an outer surface, an inlet in at least one end and having outlet apertures axially spaced apart and extending transversely through said central supply tube outer surface along its length, and c. a plurality of spray controllers situated lengthwise along said central supply tube, each of said spray controllers formed of end-to-end cylinders through which said central supply tube extends axially, each spray controller (i) having an outer surface radially outward from said outer surface of said central supply tube, and (ii) including on said surface of each of said spray controllers a plurality of spray nozzles which are directed in a plurality of directions, and said supply tube apertures configured for supplying fluid from said central supply tube to each of said plurality of spray nozzles.

2. The spray apparatus according to claim 1 where each of said spray controllers comprises a generally pyramidal shape with its base adjacent the outer surface of said spray controller and its apex extending outward therefrom.

3. The spray apparatus according to claim 1 where each of said spray controllers comprises a hemispherical shape with its base part adjacent said outer surface of said spray controller and an opposite convex outer surface.

4. The spray apparatus according to claim 1 where said spray controllers are fixed in relationship to each other in an end-to-end relationship and fixed on said central supply tube.

5. The spray apparatus according to claim 1 further comprising a manifold for supplying fluid from said source to said inlet of said central supply tube and for coupling together said plurality of spray strips.

6. The spray apparatus according to claim 1 further comprising a spring-collar at each end of said central supply tube engaging and urging said spray controllers axially into tight mutual engagement.

7. An air cooled heat exchanger operable with a source of heat exchange fluid, comprising:

a. a housing, b. a central supply tube mounted in said housing, said central supply to having an outer surface, having an inlet in at least one end, and having outlet apertures axially spaced apart and extending transversely through said central supply tube outer surface along its length, and c. a plurality of individual spray controllers, each spray controller formed as a cylinder through which said central supply tube extends axially, said spray controllers being situated end-to-end on said central supply tube, each spray controller having an outer surface radially outward from said outer surface of said central supply tube, and said spray controllers each having plurality of spray nozzles which are directed in a plurality of directions on said outer surface of each of said spray controller.

8. The spray apparatus according to claim 7 where said heat exchange tubes have a non-finned area at their ends and said cleaning fluid manifold extends transversely of said spray strips and is situated in said heat exchanger housing in a non-finned area of said heat exchange tubes.

9. The heat exchanger according to claim 7 where said plurality of spray strips each has opposite ends which are coupled to manifolds forming a rack which is insertable between and removable from two adjacent rows of heat exchange tubes in said heat exchanger.

10. The heat exchanger according to claim 9 where said rack is fixedly mounted in said heat exchanger between a set of adjacent rows of heat exchange tubes.

11. The air cooled heat exchanger according to claim 7 further comprising a manifold for supplying said heat exchange fluid from said source to said central supply tube inlet and thence to said spray controllers, said manifold coupling together a plurality of said spray strips into a frame, said frame being mountable in said housing.

* * * * *